US006700050B2

(12) United States Patent
Sakurada et al.

(10) Patent No.: US 6,700,050 B2
(45) Date of Patent: Mar. 2, 2004

(54) BI-DIRECTIONAL SERIAL BUS SYSTEM FOR CONSTRUCTING ELECTRONIC MUSICAL INSTRUMENT

(75) Inventors: Shinya Sakurada, Shizuoka-ken (JP); Akira Iizuka, Shizuoka-ken (JP); Harumichi Hotta, Shizuoka-ken (JP); Shizuhiko Kawai, Shizuoka-ken (JP); Kozo Tokuda, Shizuoka-ken (JP); Masaki Kudo, Shizuoka-ken (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/081,449

(22) Filed: Feb. 21, 2002

(65) Prior Publication Data

US 2002/0117044 A1 Aug. 29, 2002

(30) Foreign Application Priority Data

Feb. 27, 2001 (JP) ..... 2001-051517

(51) Int. Cl.[7] ..... G10H 1/18; G10H 7/00

(52) U.S. Cl. ..... 84/615; 84/600; 84/645

(58) Field of Search ..... 84/600–603, 609–610, 84/634, 645, 649–650, 666

(56) References Cited

U.S. PATENT DOCUMENTS 5,797,752 A * 8/1998 Umezawa ..... 434/307 A
6,353,169 B1 * 3/2002 Juszkiewicz et al. ..... 84/600

* cited by examiner

*Primary Examiner*—Marlon T. Fletcher
(74) *Attorney, Agent, or Firm*—Morrison & Foerster LLP

(57) ABSTRACT

A bus system interconnects a plurality of devices of various categories constituting an electronic music instrument apparatus for exchanging signals among the devices having unique addresses. The bus system has a serial clock line for transmission of a clock signal, and a serial data line for transfer of a data signal from a source device to a destination device in synchronization with the clock signal. The source device operates as a master to commence a communicating session such as to send the clock signal to the serial clock line and to send the data signal to the serial data line in synchronization with the clock signal. The destination device operates as a slave so as to receive the data signal based on the clock signal. The source device formulates the data signal containing a unique address specifying the destination device such that the destination device can receive the data signal exclusively from the source device. The unique address contains category information designating a category to which the destination device belongs and a sub-address specifying the destination device in the designated category.

25 Claims, 11 Drawing Sheets

FIG.5

| CATEGORY ID | SUB-ADDRESS RANGE | CATEGORY NAME | PROTOCOL |
|---|---|---|---|
| 0000 | 000 | GENERAL CALL | COMMON PROTOCOL ONLY |
| 0001 | 000 | HOST TYPE | STANDARD |
| 0001 | 001 | HOST TYPE | MIDI |
| 0001 | 010..111 | HOST TYPE (RESERVED) | |
| 0010 | 000..111 | KEYBOARD TYPE | STANDARD |
| 0011 | 000..111 | PANEL TYPE | STANDARD |
| 0100 | 000..111 | COMPLEX KEYBOARD-PANEL TYPE | STANDARD |
| 0101 | 000..111 | MIDI TYPE | MIDI |

FIG.6

DATA FORMAT

STANDARD DATA (5-BYTE LENGTH)

| TRANSMISSION DESTINATION ADDRESS | TRANSMISSION SOURCE ADDRESS | DATA 1 | DATA 2 | DATA 3 |
|---|---|---|---|---|

EXTENDED DATA (17-BYTE LENGTH)

| TRANSMISSION DESTINATION ADDRESS | TRANSMISSION SOURCE ADDRESS | DATA 1 | DATA 2 | ····· | DATA 15 |
|---|---|---|---|---|---|

FIG.7

COMMON PROTOCOL

HOST RECEPTION (STANDARD DATA)

| COMMAND | DATA 1 | DATA 2 | DATA 3 |
|---|---|---|---|
| CATEGORY ID/ SUB-ADDRESS REPLY | 00h | CATEGORY ID | SUB-ADDRESS |

HOST TRANSMISSION (STANDARD DATA)

| COMMAND | DATA 1 | DATA 2 | DATA 3 | GENERAL CALL |
|---|---|---|---|---|
| CATEGORY ID/ SUB-ADDRESS REQUEST | 00h | 00h | 00h | ENABLED |
| E-BUS START | 01h | 00h | 00h | ENABLED |

FIG.8

STANDARD PROTOCOL

HOST RECEPTION (STANDARD DATA)

| COMMAND | DATA 1 | DATA 2 | DATA 3 | REMARKS |
|---|---|---|---|---|
| COMMON PROTOCOL | 0xh | → | → | SEE COMMON PROTOCOL TABLE |
| SW OFF (16 PORTS×256) | 6xh | SW NUMBER (8 bit) | 00h (DUMMY) | |
| SW ON (16 PORTS×256) | 7xh | SW NUMBER (8 bit) | 00h (DUMMY) | |
| KEYBOARD OFF | 8vh | NOTE NUMBER (8 bit) | VELOCITY (MSB 8bit) | OUTPUT MIDI-COMPATIBLE SEVEN HIGH-ORDER bits |
| KEYBOARD ON | 9vh | NOTE NUMBER (8 bit) | VELOCITY (MSB 8bit) | OUTPUT MIDI-COMPATIBLE SEVEN HIGH-ORDER bits |
| POLYPHONIC AFTER-TOUCH (16 PORTS) | Axh | NOTE NUMBER (8 bit) | AFTER-VALUE (8 bit) | |
| CONTINUOUS CONTROLLER (8 bitS) (16 PORTS×256) | Bxh | KIND (8 bit) | VALUE (8 bit) | |
| JOG CONTROLLER (RELATIVE VALUE, 8 bits) (16 PORTS×256) | Cxh | KIND (8 bit) | VALUE (8 bit) | VALUE OF TWO'S-COMPLEMENT NUMBER |
| AFTER-TOUCH (16 PORTS) | Dxh | VALUE (EIGHT HIGH-ORDER bits) | VALUE (EIGHT LOW-ORDER bits) | |
| CONTINUOUS CONTROLLER (16 bits) (16 PORTS) | Exh | VALUE (EIGHT HIGH-ORDER bits) | VALUE (EIGHT LOW-ORDER bits) | |

x : PORT NUMBER v : VELOCITY

HOST TRANSMISSION (STANDARD DATA)

| COMMAND | DATA 1 | DATA 2 | DATA 3 | REMARKS |
|---|---|---|---|---|
| COMMON PROTOCOL | 0xh | → | → | SEE COMMON PROTOCOL TABLE |
| LED CONTROL (16 PORTS) | 6xh | GROUP NUMBER (8 bit) | LED INTENSITY (8 bit) | NO CHANGE ALLOWED IN GROUP 00h AND FFh |
| LED (16 PORTS×256) | 7xh | LED NUMBER (8 bit) | GROUP NUMBER (8 bit) | |
| KEYBOARD LED CONTROL (16 PORTS) | 8xh | GROUP NUMBER (8 bit) | LED INTENSITY (8 bit) | NO CHANGE ALLOWED IN GROUP 00h AND FFh |
| KEYBOARD LED (16 PORTS×256) | 9xh | NOTE NUMBER (8 bit) | GROUP NUMBER (8 bit) | |
| CONTINUOUS CONTROLLER (16 PORTS×256) | Bxh | KIND (8 bit) | KIND (8 bit) | ELECTRICALLY-DRIVEN VOLUME |
| JOG CONTROLLER (RELATIVE VALIE, 8 bits) (16 PORTS×256) | Cxh | KIND (8 bit) | KIND (8 bit) | VALUE OF TWO'S-COMPLEMENT NUMBERS ELECTRICLLY-DRIVEN JOG |
| CONTINUOUS CONTROLLER (16 bits) (16 PORTS) | Exh | VALUE (EIGHT HIGH-ORDER bits) | VALUE (EIGHT LOW-ORDER bits) | ELECTRICALLY-DRIVEN VOLUME |

x : PORT NUMBER

FIG9

MIDI PROTOCOL

HOST TRANSMISSION/RECEPTION i : NUMBER n : CHANNEL NUMBER

| COMANND | DATA FORMAT | DATA 1 | DATA 2 | DATA 3 | REMARKS |
|---|---|---|---|---|---|
| COMMON PROTOCOL | STANDARD DATA | 0xh | → | → | SEE COMMON PROTOCOL |
| START AND CONTINUE OF SysEX | EXTENDED DATA | 4ih | | | SEE USB PROTOCOL |
| END OF SysEX OR ONE PACKET | EXTENDED DATA | 5ih | | | SEE USB PROTOCOL |
| Song Pos | STANDARD DATA | 6ih | F2 COMPATIBLE | F2 COMPATIBLE | F2-EQUIVALENT FUNCTION DATA 2 AND 3 ARE L AND H |
| MIDI PORT SELECT | STANDARD DATA | 7ih | 00h | 00h | F5-EQUIVALENT FUNCTION |
| MIDI COMPATIBLE (note , Vel) | STANDARD DATA | 8nh | MIDI COMPATIBLE | MIDI COMPATIBLE | |
| MIDI COMPATIBLE (note , Vel) | STANDARD DATA | 9nh | MIDI COMPATIBLE | MIDI COMPATIBLE | |
| MIDI COMPATIBLE (note , Aft) | STANDARD DATA | Anh | MIDI COMPATIBLE | MIDI COMPATIBLE | |
| MIDI COMPATIBLE (CtrNo., , Value) | STANDARD DATA | Bnh | MIDI COMPATIBLE | MIDI COMPATIBLE | |
| MIDI COMPATIBLE (PrgNo., , 00) | STANDARD DATA | Cnh | MIDI COMPATIBLE | 00h | |
| MIDI COMPATIBLE (Aft, 00) | STANDARD DATA | Dnh | MIDI COMPATIBLE | 00h | |
| MIDI COMPATIBLE (BendL,H) | STANDARD DATA | Enh | MIDI COMPATIBLE | MIDI COMPATIBLE | |
| F0 (System Exclusive Status) | STANDARD DATA | → | → | → | NOT USED (NOTE : F0h IS CONVERTED TO 4xh OR 5xh) |
| F1 (MIDI Timecode Quater Flame) | | Fih | F1h | MIDI COMPATIBLE | |
| F2 (Song Position pointer) | | → | → | → | NOT USED (NOTE : F2h IS CONVERTED TO SongPos 6xh) |
| F3 ((Song Select) | | Fih | F3h | MIDI COMPATIBLE | |
| F4 (UNDEFINED) | | → | → | → | |
| F5 (UNDEFINED, MIDI Time Piece) | | → | → | → | NOT USED (NOTE : F5h IS CONVERTED TO PORT SELECT 7xh) |
| F6 (Tune Request) | | Fih | F6h | 00h | |
| F7 (End of Exclusive) | | → | → | → | NOT USED (NOTE : F7h IS CONVERTED TO PORT SELECT 5xh) |
| SYSTEM REAL-TIME MESSAGE | | Fih | F8h~FFh | 00h | (NOTE : DISCARD FEh) |

BI-DIRECTIONAL SERIAL BUS SYSTEM FOR CONSTRUCTING ELECTRONIC MUSICAL INSTRUMENT

BACKGROUND OF THE INVENTION

The present invention relates to a bi-directional serial bus system suitable for constructing an electronic musical instrument.

In conventional electronic musical instruments, one type of electronic musical instrument has only a single CPU (Central Processing Unit). Keyboard switches for detecting operations of each key on a keyboard, and panel operators such as panel switches for making various settings such as timbre setting are connected to a parallel I/O (Input-output). The CPU retrieves operation information about the keyboard switches and panel operators through the parallel I/O, generates a sound parameter based on the operation information, and transfers the sound parameter to a tone generator in response to sounding timing so that the tone generator will generate a sound.

There is also known another type of conventional electronic musical instrument provided with two or more CPUs. In such a type of electronic musical instrument provided with two or more CPUs, the CPUs share the operations and functions. For example, a keyboard CPU scans keyboard switches to detect and output operation information about each key. A panel CPU scans panel operators to detect and output operation information about each panel operator while controlling a display on a panel display device. A main CPU receives a keyboard input signal from the keyboard CPU and operation information about the panel operators from the panel CPU, generates a sound parameter based on the operation information, and transfers the sound parameter to a tone generator in response to sounding timing so that the tone generator will generate a sound. In this case, the main CPU is connected to the keyboard CPU and the panel CPU through independent serial communication paths, respectively, for communicating with each other through the communication paths.

The conventional electronic musical instruments provided with only one CPU vary in functions and shape from a product to product. Therefore, a circuit board incorporated in each electronic musical instrument needs to be individually designed for and mounted in the electronic musical instrument, which makes it impossible to use a circuit board mounted in an existing product to another new product because of lack of compatibility and universality.

Further, in the conventional electronic musical instruments provided with two or more CPUS, communication specifications between the main CPU and the keyboard CPU, and communication specifications between the main CPU and the panel CPU are determined separately for each product. Therefore, various circuit boards mounted in existing different products may not be connected to each other, which makes it impossible to re-use those circuit boards because of lack of compatibility and universality. Further, if a plurality of keyboards are required, an additional keyboard circuit board with a keyboard CPU mounted thereon must be connected to a main circuit board on which the main CPU is mounted. Then new connection hardware must be added to the main circuit board, resulting in a redesign of the main circuit board.

SUMMARY OF THE INVENTION

It is therefore an object of the present invention to provide an electronic musical instrument bus system capable of conducting communication among a plurality of devices constituting the electronic musical instrument through a bus by simply connecting the devices to the bus.

In attaining the above-mentioned object and according to one aspect of the present invention, there is provided a bus system interconnecting a plurality of devices of various categories constituting an electronic music instrument apparatus for exchanging signals among the devices having unique addresses. The bus system comprises a serial clock line connecting to the devices for transmission of a clock signal, and a serial data line connecting to the devices for transfer of a data signal from a source device to a destination device in synchronization with the clock signal. The source device operates as a master to commence a communicating session such as to send the clock signal to the serial clock line and to send the data signal to the serial data line in synchronization with the clock signal. The destination device operates as a slave during the communicating session such as to receive the data signal through the serial data line based on the clock signal fed from the serial clock line. The source device formulates the data signal containing a unique address specifying the destination device such that the destination device can receive the data signal exclusively from the source device. The unique address comprises category information designating a category to which the destination device belongs and a sub-address specifying the destination device in the designated category.

In the above-mentioned electronic musical instrument bus system according to the present invention, the devices are classified into four categories of a host type having a first priority, a keyboard type having s second priority, a panel type having a third priority and a MIDI type having a fourth priority. In case that two or more of source devices try to commence respective communicating sessions to respective destination devices of different categories, the source device having the communicating session to the destination device of the category having the highest priority precedes as the master of the communicating session.

Further, in the above-mentioned electronic musical instrument bus system according to the present invention, the source device produces the data signal composed of data and index information which precedes the data and indicates a kind of the data.

Furthermore, the above-mentioned electronic musical instrument bus system, according to the present invention, adapts to a plurality of specific protocols dedicated to a plurality of categories of the devices and a general protocol common to all of the categories. The source device can selectively use either of the specific protocol dedicated to the destination device or the general protocol for handling the communicating session between the source device and the destination device.

Furthermore, in the above-mentioned electronic musical instrument bus system according to the present invention, a source device belonging to a category of a host type can use a plurality of protocols dedicated to respective categories of the devices. The source device belonging to the category of the host type selects the protocol dedicated to the category of the destination device for handling the communicating session between the source device and the destination device.

Furthermore, in the above-mentioned electronic musical instrument bus system according to the present invention, the source device belonging to the category of the host type formulates the data signal containing an address which corresponds to the selected protocol and which specifies the destination device such that the source device can handle the communicating session with the destination device by the selected protocol.

According to the above-mentioned aspect of the present invention, communication among devices constituting an electronic musical instrument can be carried out through the bus system. In this case, the data signal sent from the master is given an address unique to the device of the data transmission destination, and the address consists of category information indicative of the category of the device and the sub-address specifying one of devices in the same category. Thus the communication among various category devices can be carried out through the bus system. In such an electronic musical instrument, for example, when a keyboard is newly developed as a device, the keyboard has only to be connected to the electronic musical instrument bus system to construct the electronic musical instrument. In this case, the other devices such as the panel and host devices can be used as they are.

Further, when a device is added for grade-up of a function, the device to be added has only to be connected to the electronic musical instrument to construct an electronic musical instrument with a new device added thereto. Therefore, product development costs can be remarkably reduced, and any function can be added in a short time.

Thus the present invention allows each device to be used in different products, which in turn makes it possible to develop the products on a device basis while maintaining the compatibility and universality.

In another aspect of the present invention, there is provided a bus system comprising a bus supporting a session of transfer of music data by a bi-directional serial communication, and a plurality of devices interconnected to each other through the bus to constitute an electronic musical instrument apparatus such that one of the devices may become a master by its own initiative to conduct a session, and another of the devices may become a slave when addressed by the master during the session. The devices include a manual input device being composed of either a keyboard or an operating panel for inputting the music data and being adaptable to the bus for conducting a session of transfer of the music data, a MIDI device being designed for treating the music data in MIDI format and being adaptable to the bus for conducting a session of transfer of the music data, and a host device being capable of controlling the manual input device and the MIDI device and being adaptable to the bus for conducting a session of transfer of the music data.

Further, in the above-mentioned electronic musical instrument bus system according to the present invention, the session held between the host device and the manual input device is designed to transfer the music data in a packet form having a first data length, and the session held between the host device and the MIDI device treats the music data including a MIDI message and a system exclusive message such that the session transfers the MIDI message in a packet form having the first data length and transfers the system exclusive message in another packet form having a second data length longer than the first data length.

According to the above-mentioned aspect of the present invention, major packet lengths of MIDI messages exchanged between the operation/input devices such as the keyboards or panels and the MIDI devices are integrated into the fist predetermined length, which makes it possible to simplify reception processing by each device. Further, since only the system exclusive message that tends to be longer in byte length is transmitted as the second predetermined-length packet longer in packet length than the first predetermined-length packet, communication efficiency of the system exclusive cannot decrease.

Furthermore, in the above-mentioned electronic musical instrument of the present invention, the manual input device includes a plurality of visual elements for visually indicating music information. The host device can initiate a session to transfer music data including a group message and a mode message to the manual input device. The group message is effective to divide the plurality of the visual elements into groups, and the mode message is effective to totally control a mode of indicating the music information by the visual elements in the same group.

Furthermore, the groups may include a group containing visual elements having a fixed mode of indicating the music information.

According to the above-mentioned aspect of the present invention, the plural visual elements can be controlled at the same time. Further, if few changes in combination of visual elements to be controlled occur, the number of command issued for controlling the displays can be reduced.

Furthermore, in the above-mentioned electronic musical instrument according to the present invention, a session held between the host device and the MIDI device is designed to transfer the music data representing a MIDI message composed of a status byte and data bytes subsequent to the status byte. The MIDI message is transmitted in the form of a packet containing index information and a header. The index information indicates a type of the MIDI message and substitutes the status byte. The header contains an address specifying a destination device of the MIDI message.

Furthermore, in the above-mentioned electronic musical instrument bus system according to the present invention, the destination device reconstructs the received packet into the MIDI message by changing the index information contained in the package into the corresponding status byte.

According to the above-mentioned aspect of the present invention, any MIDI message can be transmitted and received in the electronic musical instrument bus system without affecting the universality of the MIDI message.

BRIEF DESCRIPTION OF THE DRAWINGS

FIG. 5 is a table showing category IDs, sub-address ranges, category names and adaptive communication protocol.

FIG. 6 is a diagram showing data formats in the E-bus system according to the embodiment of the present invention.

FIG. 7 is a table showing host transmission/reception commands of a common protocol in the E-bus system according to the embodiment of the present invention.

FIG. 8 is a table showing host transmission and reception commands of a standard protocol in the E-bus system according to the embodiment of the present invention.

FIG. 9 is a table showing host transmission and reception commands of a MIDI protocol in the E-bus system according to the embodiment of the present invention.

DETAILED DESCRIPTION OF THE INVENTION

Figure 1:
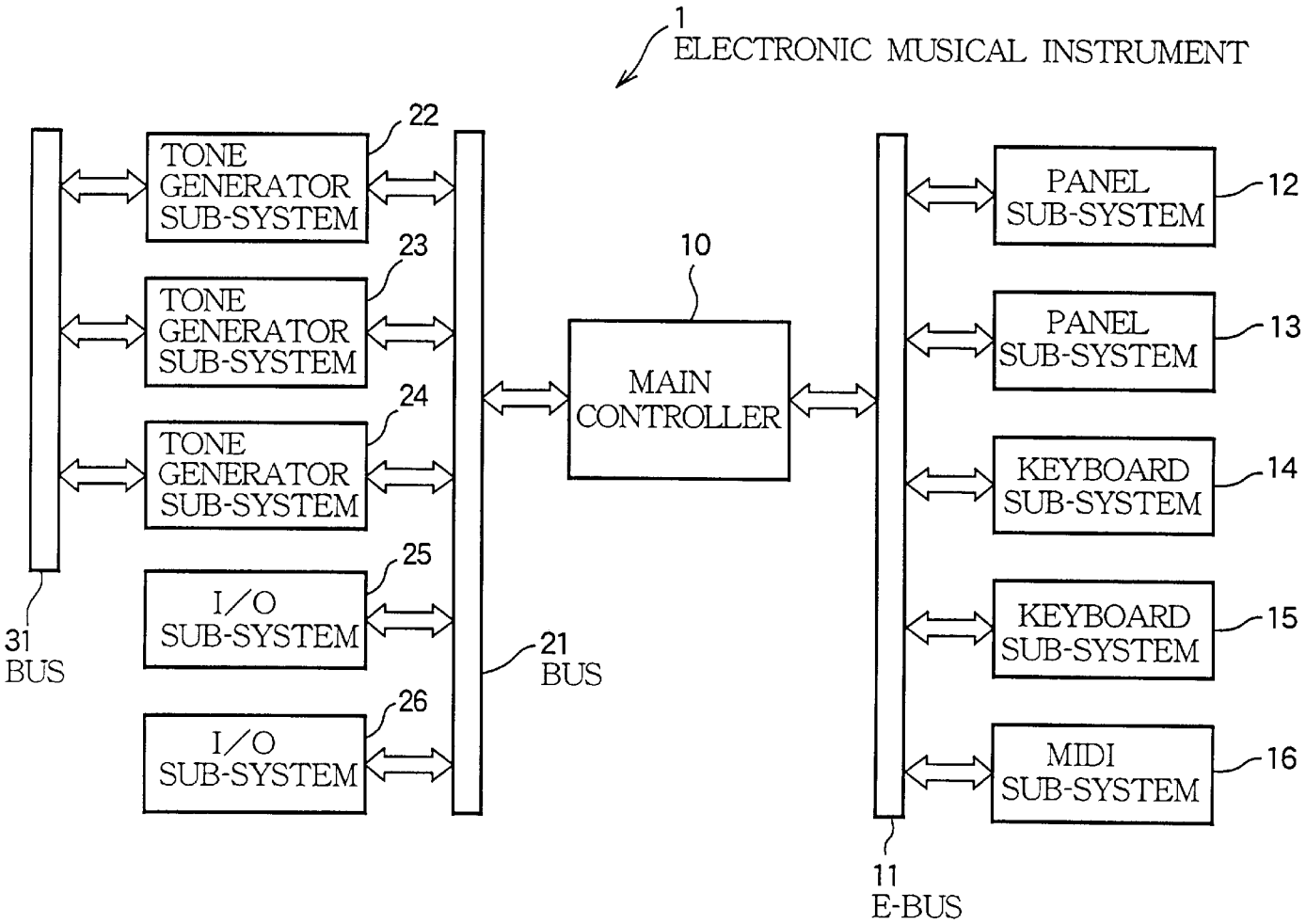
FIG. 1 is a block diagram showing a hardware configuration of an electronic musical instrument as practiced in an embodiment to which an electronic musical instrument bus system according to the present invention is applied.
Figure 2:
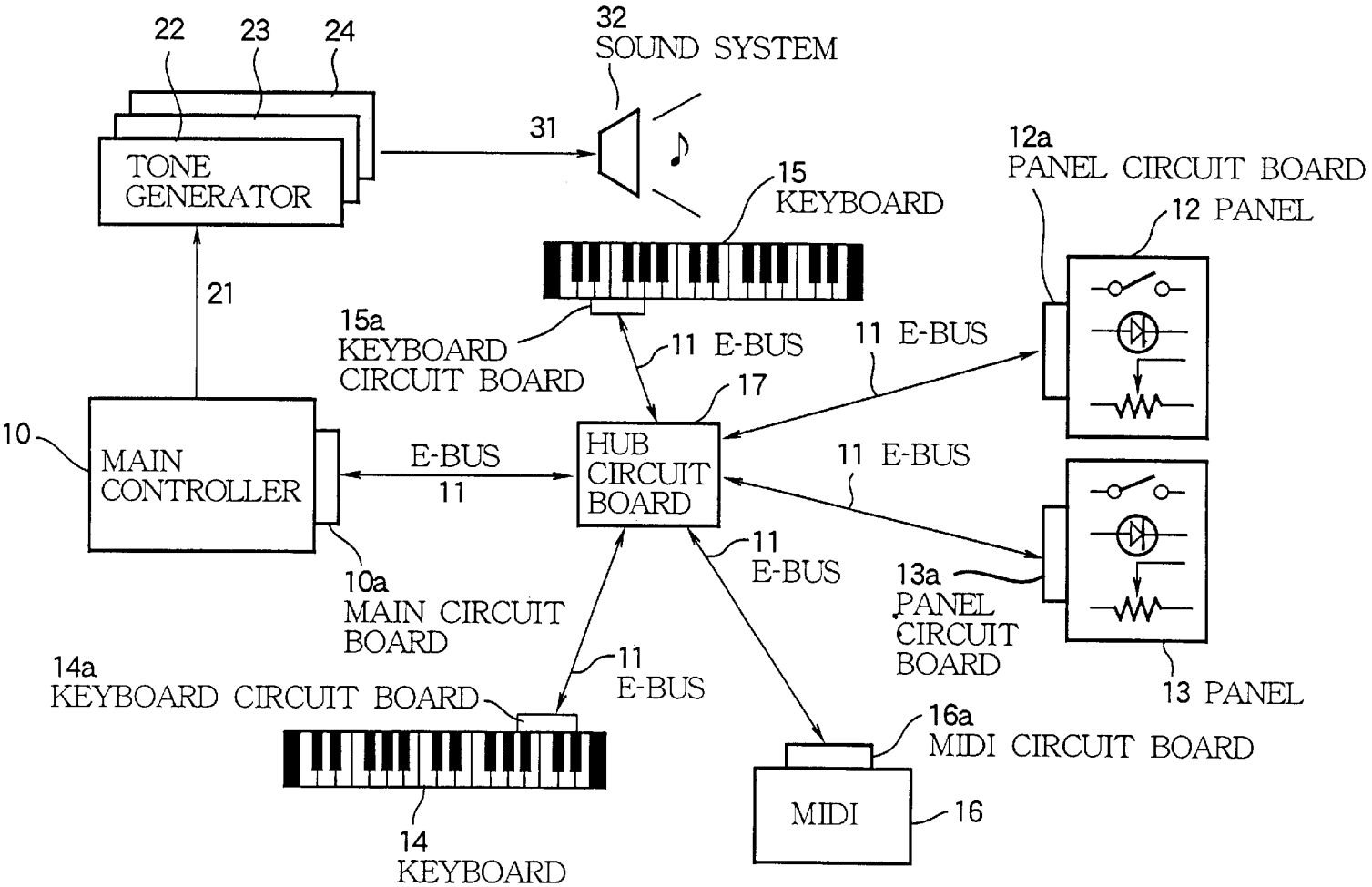
FIG. 2 is a configuration diagram showing an overview of connections of the electronic musical instrument bus system according to the present invention.

FIG. 1 is a block diagram showing a hardware configuration of an electronic musical instrument to which an electronic musical instrument bus system according to the present invention is applied. FIG. 2 is a connection diagram of the electronic musical instrument bus system according to the present invention.

The electronic musical instrument bus system according to the present invention is denoted as an E-bus system which includes an E-bus 11 incorporated in electronic musical instrument 1 shown in FIG. 1, and an E-bus system which includes connections of the E-bus 11 is shown in FIG. 2. The E-bus 11 in the E-bus system is connected with a main controller device 10 (host device), panel devices 12, 13, keyboard devices 14, 15, and a MIDI device 16. The main controller device 10 is provided with a main circuit board 10*a* on which a main CPU(Central Processing Unit), a main ROM(Read Only Memory), a main RAM(Random Access Memory) and the like are mounted. The panel devices 12, 13 are provided with panel circuit boards 12*a*, 13*a*, respectively, each of which mounts a panel CPU, a panel ROM and a panel RAM thereon. The keyboard devices 14, 15 are provided with keyboard circuit boards 14*a*, 15*a*, respectively, each of which mounts thereon a keyboard CPU, a keyboard ROM, a keyboard RAM and the like. The MIDI device 16 is provided with a MIDI circuit board 16*a* on which a MIDI CPU, a MIDI ROM, a MIDI RAM and the like are mounted.

The main controller device 10 controls the entire operation of the electronic musical instrument 1, and performs control processing for generating a tone based on operation information of keyboard switches and panel operators inputted from the keyboard devices 14, 15 and the panel devices 12, 13, and control processing for generating a tone according to a MIDI (Musical Instrument Digital Interface) message. In the main controller device 10, a control program executed by the main CPU and preset data such as timbre data and accompaniment patterns are stored in the main ROM mounted on the main circuit board 10*a*. Further, a working memory area, which the main CPU uses when it executes the control program and the like, and a user area for timbre data and accompaniment patterns are set in the RAM mounted on the main circuit board 10*a*.

The panel devices 12, 13 are each provided with a panel switch for setting timbres and effects, a continuous controller like a volume or wheel, and a panel operator such as a JOG controller, so that the selection of timbres and timbre parameters can be changed. The panel CPU scans the panel operators provided in the panel devices 12, 13 to detect input events and manipulated variables. In this case, the manipulated variables may be detected as relative values depending on the panel operator. In the panel devices 12, 13, a scan program and the like executed by the panel CPU are stored in the panel ROM mounted on the panel circuit boards 12*a*, 13*a*, respectively. Further, memory areas such as a working memory area used when the panel CPU executes the scan program and the like are set in the panel RAM mounted on the panel circuit boards 12*a*, 13*a*, respectively.

The keyboard devices 14, 15 are each provided with plural keys and keyboard switches that are turned on and off in response to operations of the respective keys. The keyboard CPU scans the keyboard switches provided in the keyboard devices 14, 15 to detect values of key events indicative of note-on/note-off, velocity and after-touch. In the keyboard devices 14, 15, a scan program and the like executed by the keyboard CPU are stored in the keyboard ROM mounted on keyboard circuit boards 14*a*, 15*a*, respectively. Further, a working memory area and the like used when the keyboard CPU executes the scan program and the like are set in a keyboard RAM mounted on keyboard circuit board 14*a*, 15*a*, respectively.

The MIDI device 16 is a MIDI-compatible device such as a MIDI input/output device provided with a MIDI terminal and a To-Host terminal, an automatically performable sequencer and a MIDI keyboard. The MIDI device 16 may be provided with a To-Host terminal for establishing a connection to a host computer. In the E-bus system, the MIDI device 16 can send and receive performance data and performance related data directly in the MIDI format. The MIDI CPU controls the operation of the MIDI device 16. In the MIDI device 16, a MIDI control program executed by the MIDI CPU and MIDI control data are stored in the MIDI ROM mounted on MIDI circuit board 16*a*. Further, a working memory area and the like used when the MIDI CPU executes the MIDI control program are set in the MIDI RAM mounted on the MIDI circuit board 16*a*. The provision of the To-Host terminal in the MIDI device 16 can change the electronic musical instrument to a To-Host terminal equipped model.

In the electronic musical instrument 1 as shown in FIGS. 1 and 2, the main controller device 10 receives performance event data and performance related data regarding the timbres and the like through the E-bus 11 connecting between the main controller device 10 and the panel device 12, 13, the keyboard device 14, 15 and the MIDI device 16. Then, the main controller device 10 sends sound control data to tone generator units 22, 23 and 24 through a bus 21 as soon as an event starting time comes so that the tone generator units 22, 23 and 24 will start generating tones. The tones generated at the tone generator units 22, 23 and 24 are supplied to a sound system 32, and emitted from the sound system 32. The bus 21 can be connected with other units through I/O units 25, 26.

In connecting the main controller device 10, the panel devices 12, 13, the keyboard device 14, 15 and the MIDI device 16 to the E-bus system as practiced in the embodiment, connectors provided at ends of wires constituting the E-bus 11 are engaged into bus terminals provided on the respective device boards as shown in FIG. 2. The other ends of the wires are connected to signal lines and power lines, respectively, constituting the E-bus 11 around a hub circuit board 17. Thus the connectors of the E-bus 11 are coupled to the respective device boards so that each device can be connected to the E-bus system. For this reason, the device can also be removed from the connector of the E-bus 11 as required, which enables free addition and removal of the device to and from the E-bus system. It should be noted that the devices connected to the E-bus system are supplied with power from the E-bus 11. In the configuration shown in FIG. 2, a power source, not shown, on the hub circuit board 17 supplies power. Each connector of the E-bus 11 may be a 7-pin connector in which three pins are used for signal lines and the remaining four pins for power supply. Further, each connector equipped in the E-bus has the same standardized configuration or arrangement, and each bus terminal equipped in the devices has the same standardized configuration or arrangement.

Suppose that the E-bus system according to the embodiment is used in the electronic musical instrument 1. In this case, if the electronic musical instrument 1 is to be an organ type electronic two-stage keyboard instrument, it will have only to attach the keyboard device 14 and the keyboard device 15 to the connectors, respectively, of the E-bus connected with the main circuit board, the panel circuit boards and the like. On the other hand, if the electronic musical instrument 1 is to be an organ type electronic three-stage keyboard instrument, it will have to attach a further additional keyboard device to a connector of the E-bus 11. Further, in the electronic musical instrument whose main circuit board, panel circuit boards, keyboard circuit boards are connected to the E-bus, only the keyboard devices may be replaced to modify the electronic musical instrument 1, for example, from a 61-key electronic musical instrument model to a 76-key electronic musical instrument model. The panel devices may also be replaced to bring the electronic musical instrument 1 into correspondence with another model with many or few panel switches. Thus, some of the plural circuit boards constituting the electronic musical instrument can be added, removed and changed independently of one another.

For example, a keyboard device connected to a connector of the E-bus may be removed, and a panel device may be coupled to the same connector in place of the removed keyboard device. In general, various devices of different categories can be selectively coupled to the same connector. Further, any device can be detached from one connector of the E-bus system, and the detached device can be attached to another connector of the same E-bus system. Thus, E-bus system establishes the compatibility and universality of the devices and connections.

The E-bus system used as the electronic musical instrument bus system according to the present invention will be described below in detail.

The E-bus system is a two-way or bi-directional serial bus with three signal lines, namely a serial clock line (hereinafter called the "SCL line"), a serial data line (hereinafter called the "SDA line"), and an initial clear line. In this case, a data signal is sent to the SDA line in synchronism with a clock signal sent to the SCL line. And, a reset signal is sent to the initial clear line upon start-up or reset of the E-bus system. The E-bus system includes four power lines from which power is supplied to the devices connected to the E-bus system. The communication speed of the E-bus system may be any one of 100 kbps, 400 kbps and 3.4 Mbps.

The E-bus system can be connected with plural devices sequentially (bus-type connection), assigning a unique, inherent address to each device connected to the E-bus system. The inherent address, for example, is a 7-bit address. FIG. 5 shows a table of inherent addresses. As shown, each inherent address consists of a 4-bit category ID and a 3-bit sub-address. The category ID indicates the type of category, and the sub-address is an address indicative of an individual device out of devices of the same category type. The category ID indicative of the type of category as the high-order bits of the address is preset according to the type of category of the device in the manufacturing process of the circuit board of the device. The sub-address is set through a jumper-pin or dip switch assembly not to overlap with sub-addresses of other devices of the same type when incorporated in the electronic musical instrument 1. The categories are divided into a host type to which the main controller device 10 belongs, a keyboard type to which the keyboard devices 14, 15 belong, a panel type to which the panel devices 12, 13 belong, a Midi type to which the MIDI device belongs, and a combination keyboard-panel type that combines the keyboards and panels.

Communications among devices on the E-bus system are carried out according to the master-to-slave communication scheme including multi-master communications. The master is a device capable of starting a data transfer onto the E-bus system. The master can also generate a clock pulse to output the same to the SCL line so as to enable the transfer or end the data transfer. The slave is a transmission destination device to be addressed by the master. The term "multi-master" denotes that plural masters can control the E-bus system simultaneously without loss of message data.

The E-bus system allows for simultaneous data transfers on the E-bus system. In other words, the E-bus system has a function for detecting a collision between data and an arbitration function to prevent data corruption. The E-bus system performs arbitration according to the category name priorities on the transmission destination side. The category name is to expand the type of category. FIG. 5 shows a table of inherent addresses and category names. Of all the priorities, the category name "General Call" indicating that all the devices are transmission destinations is assigned the highest priority. Then the category name "Host type" is the second, "Keyboard type" is the third, "Combination Keyboard/Panel type" is the fourth, and "Panel type" is the fifth. The lowest priority is assigned to the category name "Midi type." These priorities are decided from importance and real-time standpoints.

Further, the E-bus system carries out communication using a communication protocol corresponding to the category name to which the transmission source address and the transmission destination address belong. FIG. 5 shows a table of the category names and communication protocols. As shown in FIG. 5, when communication between the keyboard type to which the keyboard devices 14, 15 belong or the panel type to which the panel devices 12, 13 belong, and the host type to which the main controller device 10 belongs is conducted, a standard protocol to be described later as a man-machine interface protocol is used for the communication. When communication between the Midi type to which the MIDI device 16 belongs and the host type to which the main controller device 10 belongs is conducted, a MIDI protocol to be described later as a performance information transfer protocol is used. If the category name is "General Call," the host type will communicate with the keyboard type, the panel type, and the Midi type using a common protocol to be described later as a control protocol. The common protocol is composed of common parts of the standard protocol and the MIDI protocol. In this case, only the host type can transmit data to the General Call address "0000 000." The other devices in the keyboard type, the panel type and the Midi type have to use their own addresses upon transmission based on the common protocol.

Thus the main controller device 10 of the host type can perform communication using the communication protocol corresponding to the category name. When the host type communicates with another device with another category name, any communication protocol needs to be predetermined. Therefore, the host type specifies a transmission destination address prior to the communication. The transmission destination address is an address inherent in the device and whose four high-order bits represent the category ID. Therefore, the host type can refer to the table shown in FIG. 5 to obtain the category name of the device as the communication partner and the communication protocol used. As shown in FIG. 5, the host is assigned two inherent addresses corresponding to two communication protocols of the host type, so that the host type carries out communication using the address of one communication protocol corresponding to the category name of the device as the communication partner. The host type can also carry out communication under the standard protocol, where the host type uses any one of the two inherent addresses and the General Call address.

Figure 3:
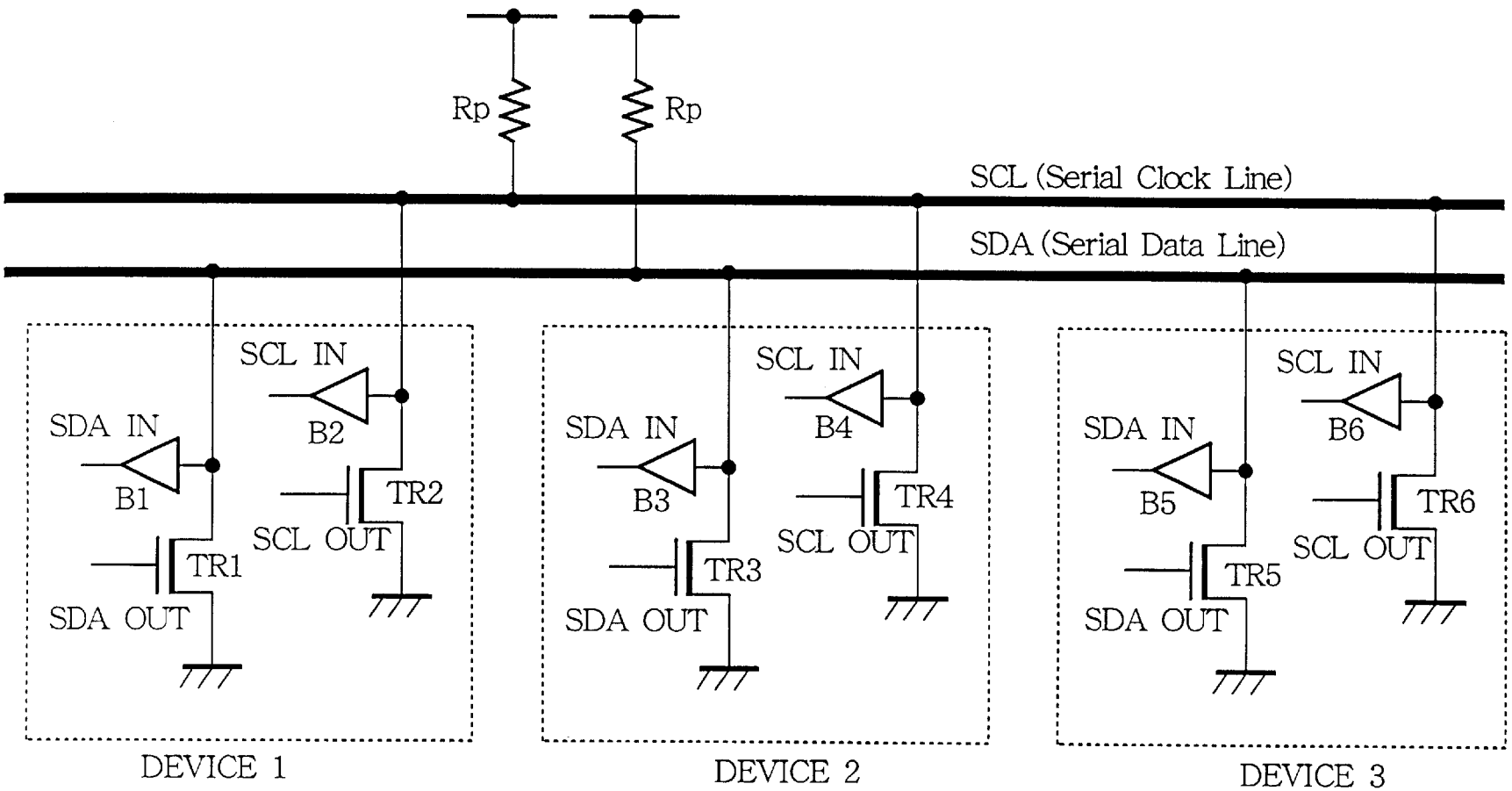
FIG. 3 is a diagram showing a specific configuration of an E-bus system according to the embodiment of the present invention.

FIG. 3 shows a specific constitution of the E-bus system according to the present invention. It should be noted that FIG. 3 shows only the two signal lines, the SCL line and the SDA line, out of seven wires constituting the E-bus system. The signal line that is not shown is an initial clear line (E-IC), and the remaining four lines are power lines. As shown in FIG. 3, a device 1, a device 2 and a device 3 are-bus-connected to the SCL line and the SDA line, respectively. Since the connections between the devices, and the SCL line and the SDA line are constructed in the same manner, description will be made below about the device 1 alone. In the device 1, a buffer B2 as a clock input part (SCL IN) is connected to the SCL line to which the clock is transferred, and the clock pulse is taken into the device 1 through the buffer B2. An open drain of a field-effect transistor (hereinafter called the "transistor") TR2 as a clock output part (SCL OUT) is also connected to the SCL line so that the clock pulse can be sent to the SCL line by turning the transistor TR2 on and off. Further, a buffer B1 as a data input part (SDA IN) is connected to the SDA line to which a data signal is transferred. The data signal is taken into the device 1 through the buffer B1. An open drain of a transistor TR1 as data output part (SDA OUT) is also connected to the SDA line so that the data signal can be sent to the SDA line by turning the Transistor TR1 on and off.

The device 2 and the device 3 are also connected to the SCL line and the SDA line in the same circuit configuration. In the devices 1 to 3 shown in FIG. 3, transistors TR1 through TR6 are field-effect transistors, but they may be bipolar transistors whose collectors are open. The SCL line and the SDA line are pulled up by pullup resistors Rp, respectively. In other words, the SCL line and the SDA line are at a high (H) level when they are open, and the SDA line is changed to a low (L) level by turning on any one of the transistors TR1, TR3 and TR5. That is, wired AND connections between the data output parts of the devices 1 to 3 and the SDA line are established. Similarly, the SCL line is at the H level in the open state, and is changed to the L level by turning on any one of the transistors TR2, TR4 and TR6 of the clock output parts in the devices. That is, wired AND connections between the clock output parts of the devices 1 to 3 and the SCL line are established.

Figure 4:
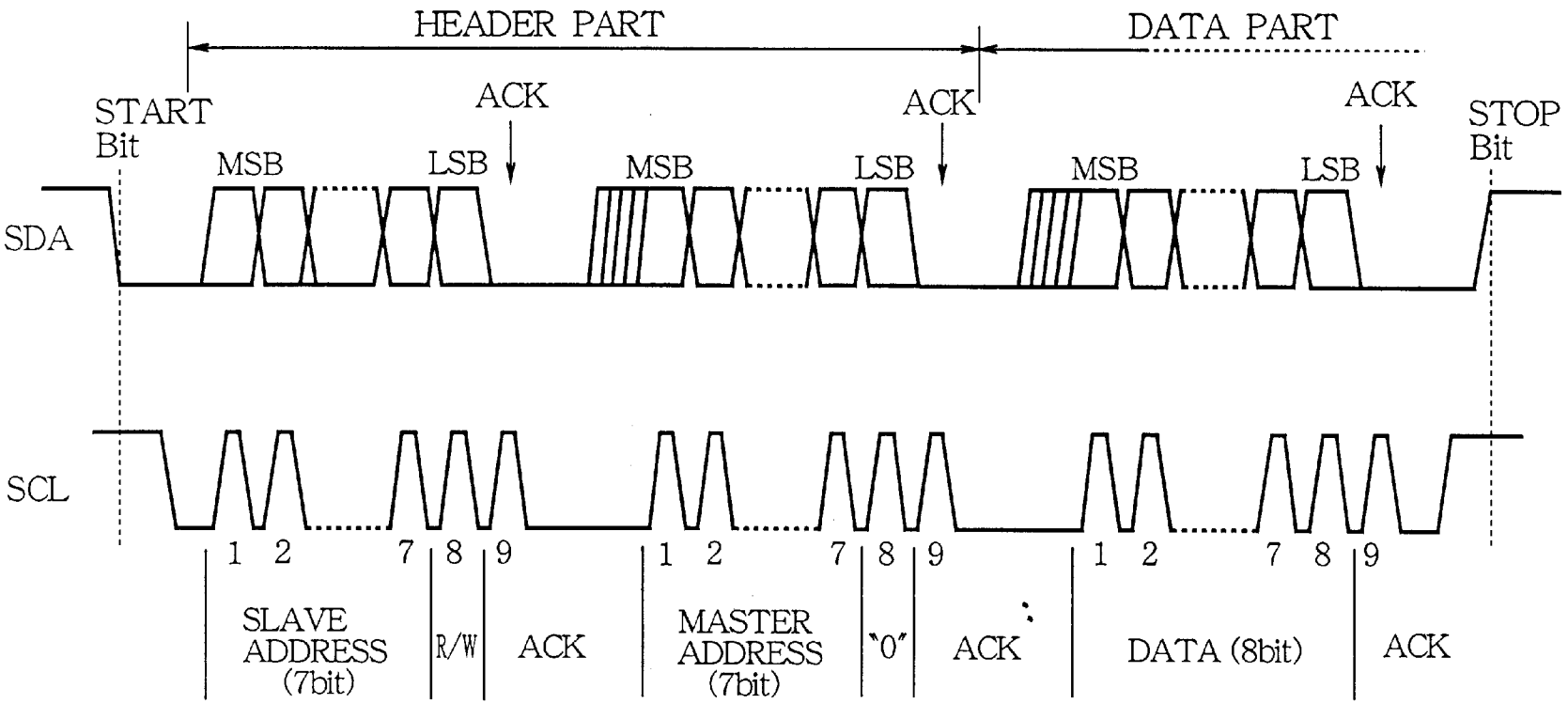
FIG. 4 is a chart showing a waveform timing observed during data transfer to SCL and SDA lines in the E-bus system according to the embodiment of the present invention.

FIG. 4 shows a waveform timing chart upon data transfer onto the SCL line and the SDA line in this E-bus system. In the E-bus system, the transfer of data can be initiated only when the bus is open (H level), and the master transfers a start bit upon the data transfer. In this case, the SDA line is reversed to the L level when the SCL line is at the H level (in the open state) to send the start bit as shown in FIG. 4. The start bit is detected by the device connected to the E-bus system, so that the device is informed of the initiation of data transfer. Next, a header part prefixed to a data part is transferred. The data part consists of plural bytes (where one byte is 8 bits), and the header part also consists of plural bytes. In this header part, a 7-bit transmission destination address (slave address) and one bit that instructs the reading and writing (R/W) of data constitute the first one byte. Then a 7-bit transmission source address (master address) and one dummy bit, "0" constitute the next one byte. Following the header part, 3 or 15 consecutive bytes of data part are transferred on a byte basis as described later. The clock pulse is also sent to the SCL line in synchronism with each bit of the head part and the data part. In this case, since the header part and the data part each consist of pieces of one-byte data, eight clock pulses 1, 2, 3 . . . 8 are sent in synchronism with each bit as shown every one byte of the header part and the data part. The header part and the data part can reverse the level of each bit while the clock pulse is at the L level. To make data of each bit effective while the clock pulse is at H level, the level of the SDA needs to be stabilized for transfer.

In the E-bus system, the clock pulse, the header part and the data part sent from the master reach all the devices through the SCL line and the SDA line. Then each device compares the slave address in the header part received first with its own inherent address on a bit basis. If the 7-bit slave address and its own address coincide with each other, the device finds that its own machine is addressed as a slave, and receives the following data. Suppose that even though the level of SDA line is L (or H), a corresponding bit of its own address is "1" (or "0"). In this case, since its own machine is not addressed as a slave, the device judges that its own machine is not the transfer destination and rejects the following received data. Thus only the addressed device can receive data.

In the header part, the eighth bit of each byte is to instruct reading/writing of data. In the E-bus system, however, the bit is always kept at L (equal to "0"), that is, the bit represents a write-only data format. Since electronic musical instrument is required to respond to operations of the keyboards, the panels and the like in real time, the writing of the operation events in the keyboard type and the panel type to transmit the same so as to the host type enhances the response.

The master sends the next one byte signal after it confirms that one byte-based signal in the header part and the data part sent to the SDA line is received normally. After the one byte signal is sent, the master sends the SCL line a ninth acknowledgment clock pulse (ACK), which indicates whether the one byte signal is received as an effective signal. At the same time, the master opens the SDA line and changes the level to H. When the one byte signal is received as an effective signal, the transmission destination device addressed at the slave address of the header part turns on the transistor of the data output part and keeps the SDA line at the L level. While the ninth ACK clock is holding the H level, the master takes in the level of the SDA line, and when the acknowledgment pulse exhibits the L level, the master confirms that the transmission destination device has received the one byte signal normally. Thus the master can send the next one byte to the SDA line. At this time, the transmission destination device keeps the SCL line at the L level until it is ready for reception. After a lapse of a predetermined time period, the master starts sending the SDA line the next one byte serially from the first bit, and the SCL line the synchronizing clock pulses. Then, if the transmission destination device is ready to receive, the clock pulses of the SCL line rise sequentially so that the transmission destination device can take in the next one byte in response to the clock pulses. On the other hand, if the transmission destination device is not ready, the SCL line is kept at the L level. Therefore, no clock pulse sent from the master appears on the SCL line, and the master waits until the SCL line rises. When the transmission destination device is made ready to receive, the SCL line is released, so that the clock pulses rise on the SCL line, thus transmitting the next one byte. If the transmission destination device fails to receive the effective one byte signal, an H-level acknowledgment signal is created and received by the master. In this case, the master reverses the SDA line to the H level while keeping the SCL line at the H level to send a stop bit so as to stop the data transfer. The master also sends stop bit to the E-bus 11 upon completion of the communication.

The following describes arbitration. In the E-bus system, data transfer can be initiated only when the bus is open (H level). Then, if two or more devices start data transfer as masters almost at the same time, arbitration will be performed to permit any one of the masters to communicate. The arbitration process takes advantage of the fact that wired AND connections between the data output parts of the devices and the SDA line are established. To be more specific, when data transfer starts, as shown in FIG. 4, since the slave address is sent to the SDA line following the start bit, the plural masters compare the address received from the SDA line with a slave address addressed by its own machine on a bit basis. In this case, if the data are sent to the SDA line from plural devices at the same time, since the wired AND connections are established, the SDA line will be kept at the L level when one of the devices sends L level.

Then, in some devices, while the compared bit of the slave address specified by its own machine is "1," the bit taken in from the SDA line becomes "0" (L level). When the addresses do not coincide with each other like this case, the device determines that the other masters have higher priorities and turns the data output part off. Continuing this processing, the master assigned the highest priority is eventually permitted to communicate. As stated above, since the L level is given first priority as the level of the SDA line, the slave address that has more "0" digits from the most significant bit (MSB) is assigned higher priority. Priorities in the arbitration process are decided from the category names. As stated above, the general call is assigned the highest priority. The second priority is given in a case where the device (main controller) of the host type is the transmission destination, the third is that the device of the keyboard type is the transmission destination, the fourth is that the device of the panel type is the transmission destination, and the fifth is that the device of the Midi type is the transmission destination. It should be noted that the priority of the keyboard type is higher because real-time response is important for the keyboards.

For these reasons, a category ID is assigned to each category as shown in FIG. 5 according to its category name priority. FIG. 5 is a table showing category IDs, sub-address ranges, category names and types of communication protocols which are used. Referring to the category IDs in the table of FIG. 5, the category ID of the general call which is transferred to all the devices is "0000," which has the most "0" digits. Then, the category ID of the host type (main controller) is "0001," the category ID of the keyboard type is "0010," the category ID of the panel type is "0011," the category ID of the keyboard-panel combination is "0100," and the category ID of the Midi type is "0100." Thus the arbitration can be performed in the above-mentioned priority order. If the category IDs are the same and the master cannot be decided merely by comparing the category IDs, the decision will be made by comparing the sub-addresses. If no master can still be decided, then the decision will be made by comparing the transmission source addresses. Since the transmission destination address never coincide with the transmission source addresses, the arbitration always finishes by comparing the transmission source addresses. If the device of the host type (assigned the highest priority except in the case of a general call as special communication) is the transmission destination, the keyboard type, the panel type, the combination keyboard-panel type and the Midi type are prioritized as the transmission source in this order. These priorities are also decided from real-time requirements.

Discussing the sub-addresses, the sub-address "000" used when the category name of the device as the communication partner is the keyboard or panel type (the keyboard type, the panel type or the combination keyboard-panel type) and the sub-address used for the Midi type are prepared for the host type. In other words, if the device whose category name is the keyboard or panel type is addressed, the device takes precedence over the Midi type to communicate with the host type. It should be noted that sub-addresses "010" to "111" are reserved for different bus formats or future use. Further, if the slave addresses specified as the transmission destination coincide with each other but the master cannot be decided, the decision will be made by comparing the master addresses subsequently sent.

The keyboard type, the panel type, the combination keyboard-panel type and the Midi type are given eight sub-address ranges "000" through "111," respectively. For this reason, in the systems of these category names, eight devices of the same category can be connected to the E-bus system.

In the E-bus system, communication between devices is conducted using a communication protocol corresponding to the category of the devices. However, the communication protocol for general call is the common protocol so that communications can be conducted among devices of all the categories. As shown in FIG. 5, if the category names to communicate with the host type are the keyboard type, the panel type and the combination keyboard-panel type, the standard protocol is used for the communication. If the category name to communicate with the host type is the Midi type, the MIDI protocol is used. In this case, since each device is assigned a category ID corresponding to the category name, the communication protocol can be decided from the category ID of the slave address specified. Since the host type (main controller) needs to communicate with each device using a communication protocol corresponding to the category name of the device as the communication partner, a standard protocol address and a MIDI protocol address are prepared for the host type as shown in FIG. 5. For example, when the device of the host type communicates with the device of the Midi type, the device of the host type uses "0001 001" as the address of its own machine, while when the device of the Midi type becomes the master, "0001 001" is addressed as the slave address. Thus the device of the host type and the device of the Midi type can communicate with each other using the MIDI protocol. On the other hand, when the device of the host type communicates with any device of the keyboard type (the panel type or the combination keyboard-panel type), the device of the host type uses "0001 001" as the address of its own machine, while when the device of the keyboard type (the panel type or the combination keyboard-panel type) becomes the master, "0001 001" is addressed as the slave address. Thus the device of the host type and the device of the keyboard type (the panel type or the combination keyboard-panel type) can communicate with each other using the standard protocol.

FIG. 6 shows a data format of a packet in the E-bus system according to the present invention.

As shown in FIG. 6, as the data formats in the E-bus system, a data format for 5-byte standard data and a data format for 17-byte extended data are defined. The standard data format of length 5 bytes consists of a one-byte transmission destination address (slave address) for addressing, a one-byte transmission source address (master address), and data 1, data 2 and data 3 with one byte in each. The extended data format of length 17 bytes consists of a one-byte transmission destination address (slave address) for addressing, a one-byte transmission source address (master address), and data 1 to 15 with one byte in each. In this case, the transmission source address contains a dummy bit "0," and the transmission destination address contains an R/W bit, respectively. The standard data format is used for the common protocol, the standard protocol and the MIDI protocol, while the extended data format is used for transferring the system exclusive message and the like using the MIDI protocol. The transmission destination address and the transmission source address constitute the header part shown in FIG. 4, and the following 3- or 15-byte data constitute the data part. The data 1 in the standard and extended data is an index indicative of the kind of data to be transferred. Specifically, the index represents commands in each communication protocol. Thus packet lengths (or data byte length) are integrated into two lengths, which makes it possible to simplify each device processing during communication. In the electronic musical instrument, a 3-byte packet is most suitable for the exchange of normal commands other than exclusive. Further, the packet length of the normal commands is reduced to a short packet length of about 5 bytes (10 bytes or less), which makes it possible to accelerate an isolation time of each packet on the bus, and hence a response time to input from a keyboard or panel in the electronic musical instrument.

Next, common protocol commands will be described. Since the common protocol is a communication protocol capable of being used regardless of category of devices communicating with each other, each device can handle the common protocol during processing for the category to which the device belongs without the need to judge whether it is the common protocol. As mentioned above, in the E-bus system practiced as the electric musical instrument bus system according to the present invention, it is presumed that the device as the main controller device 10 of the host type and another device communicate with each other. FIG. 7 shows commands for host reception and host transmission. All the commands in the common protocol are represented in the standard data format. Though the following describes the commands in reverse order to that as shown, the host transmitting command column contains a category ID/sub-address request command. This command is used for the device of the host type to detect the addresses of devices connected to the E-bus system so as to enable a general call. The data 1 as the index of this command is "00h" (h indicates hexadecimal notion, that is, 00h=0000 0000), then the data 2 and the data 3 are also "00h."

When the device of the host type makes a general call to issue the category ID/sub-address request command, the command issued is standard data consisting of a transmission destination address "0000 000," a transmission source address "0001 000" (see FIG. 5), and data 1 through data 3 represented as "00h" respectively. The category ID/sub-address request command for which the general call has been made is received by the devices of all categories, and each device returns a category ID/sub-address reply command shown in the host receiving column. The category ID/sub-address reply is a command which informs the device of the host type about the address inherent in its own machine. To issue the category ID/sub-address reply command, standard data is transmitted. The standard data consists of a transmission destination address "0001 000" to be addressed, a transmission source address which is set to the 7-bit address of its own machine, data 1 "00h" as the index, data 2 indicative of the category ID of its own machine, and data 3 indicative of the sub-address of its own machine. Thus the host can know the devices connected to the E-bus system and their addresses. The category ID/sub-address request command is issued when the device of the host type makes the general call upon activation of the E-bus system. From this command, the devices connected to the E-bus system and their addresses can be known. Then, from the addresses, the category names and communication protocols to be used can be known. Thus the device of the host type can create a table as shown in FIG. 5, and the following communication can be performed by setting an address in the table created. In principle, all but the device of the host type communicate with the device of host type, and two or more addresses assigned to the host type are predetermined in the E-bus system. Therefore, all but the device of the host type do not have to create the table shown in FIG. 5 because they know in advance the addresses to be set upon communication. Since the general call is received by all the devices other than that of the host type, if the general call is used for each device to send the ID/sub-address reply, the devices other than that of the host type need processing for ignoring the general call received. Therefore, in the E-bus system according to the present invention, each device uses the host standard address as the transmission destination instead of the general call to conduct communication upon reply, which simplifies processing by the devices other than that of the host type.

An E-bus start command of the host transmitting column is basically a command issued by making a general call from the main controller device 10, and a command for enabling the E-bus system to operate upon start-up of the E-bus system. When a general call of the E-bus start command is made, standard data is transmitted. The standard data consists of a transmission destination address "0000 000," a transmission source address "0001 000," data 1 "01h" as the index, data 2 "00h," and data 3 "00h."

Next, standard protocol commands for host reception and host transmission shown in FIG. 8 will be described. The standard protocol is a communication protocol capable of being used when the device of the host type (main controller) communicates with any of the devices whose categories are the keyboard type, the panel type, and the combination keyboard-panel type. Any command in the standard protocol is represented in the standard data format.

Of all the standard protocol commands of the host receiving column, a common protocol command is the same as the common protocol shown in FIG. 7, and therefore, the explanation will be omitted. Since they are the same, the device concerned can receive and send the common protocol without switching the operation between the standard protocol and the common protocol. The following SW OFF command and SW ON command are commands for transferring, to the host, OFF and ON events of a panel switch provided in a panel device. For example, when a switch of number n of the panel switch in the panel device is turned off, the SW OFF command is issued in such a manner that the transmission destination address is "0001 000" indicating the host, the transmission source address is an address "0011 aaa" of the panel device (where "aaa" is the sub-address of the panel device concerned), the data 1 as the index is "bxh," the data2 is the number n of the switch that was turned off (8 bits), and the data 3 is dummy "00h."

When the number m switch of the panel switch in the panel device is turned on, the SW ON command is issued in such a manner that the transmission destination address is "0001 000" indicating the host, the transmission source address is an address "0011 bbb" of the panel device (where "bbb" is the sub address of the panel device concerned), the data 1 as the index is "7xh," the data 2 is the number m of the switch that was turned on (8 bits), and the data 3 is dummy "00h." Since "xh" is the port number and the switch number is represented by 8 bits, 16 ports×256 panel switch SW OFF commands and SW ON commands can be issued.

A keyboard OFF command and a keyboard ON command in the standard protocol of the host receiving column are commands for transferring, to the host, a note ON event and a note OFF event on each key in a keyboard device. Therefore, when a key corresponding to the note number n is noted off in the keyboard device, the keyboard OFF command is issued in such a manner that the transmission destination address is "0001 000," indicating the host, the transmission source address is an address "0010 aaa" of the keyboard device (where "aaa" is a sub-address of the keyboard device concerned), the data 1 as the index is "8vh," the data 2 is the number n of the note that was noted off (8 bits), the data 3 is the eight high-order bits of velocity. Since "vh" is the four low-order bits, velocity information which is a total of 12 bits is transferred, where the seven high-order bits of the 12-bit velocity information are made MIDI-compatible.

When a key corresponding to the note number m in the keyboard device is noted on, the keyboard ON command is issued in such a manner that the transmission destination address is the address "0001 000" indicating the host, the transmission source address is an address "0010 bbb" of the keyboard device(where "bbb" is a sub-address of the keyboard devices concerned), the data 1 as the index is "9vh," the data 2 is the number m of the note that was noted on (8 bits), the data 3 represents the eight high-order bits of the velocity. In this command, like in the keyboard OFF command, velocity information which is a total 12 bits is transferred, where the seven high-order bits of the 12-bit velocity information are made MIDI-compatible. In either command, since the note number is represented as 8 bits, keyboard OFF command and keyboard ON commands, each of which corresponds to 256 notes, can be issued. The reason why the port number is eliminated and the velocity information is represented in 12 bits is that, when keyboard performance is taken in, 12-bit velocity resolution higher than that of the MIDI is necessary to perform processing for a touch curve or the like.

A polyphonic after-touch command for transferring the value of a polyphonic after-touch (an after-touch on each key) in the keyboard device of host receiving column in the standard protocol is represented in such a manner that the transmission destination address is the address "0001 000" indicating the host, the transmission source address is the address "0010 aaa" of the keyboard device (where "aaa" is the sub-address of the keyboard device concerned), the data 1 as the index is "axh," the data 2 is the note number n (8 bits) of the note to which the after-touch is subjected, and the data 3 is an 8-bit after-value. Since "xh" is the port number, 16-port polyphonic after-touch commands can be issued.

A continuous controller command for transferring the operation value of a volume, a wheel or the like in a panel device of the host receiving column in the standard protocol is represented in such a manner that the transmission destination address is the address "0001 000" indicating the host, the transmission source address is an address "0011 aaa" of the panel device (where "aaa" is a sub-address of the panel device concerned), the data 1 as the index is "Bxh," the data 2 represents the kind of the controller such as the volume or wheel (8 bits), and the data 3 represents an 8-bit operation value of the controller. Since "xh" is the port number and the kind is represented in 8 bits, 16 ports×256 continuous controller commands can be issued.

A JOG controller command for transferring the operation value of a JOG controller such as a rotary encoder in the panel device of the host receiving column in the standard protocol is represented in such a manner that the transmission destination address is the address "0001 000" indicating the host, the transmission source address is the address "0011 aaa" of the panel device (where "aaa" is the sub-address of the panel device concerned), the data 1 as the index is "Cxh," the data 2 represents the kind of the JOG controller (8 bits), the data 3 is the relative value (in 8 bits) of two's-complement numbers of the operation value in the controller. Since "xh" is the port number and the kind is represented in 8 bits, 16 ports×256 JOG controller commands can be issued.

An after-touch commands for transferring the value of an after-touch (a common after-touch of plural keys on a keyboard) in the keyboard device of the host receiving column in the standard protocol is represented in such a manner that the transmission destination address is the address "0001 000" indicating host, the transmission source address is the address "0010 aaa" of the keyboard device (where "aaa" is a sub-address of the keyboard device concerned), the data 1 as the index is "Dxh," the data 2 is the eight high-order bits of a touch value, the data 3 is the eight low-order bits of the touch value. Since "xh" is the port number, 16-port after-touch commands can be issued. The touch value transferred in this after-touch command is a touch value applied to all the notes that are noted on in a keyboard device as the master (transmission source).

A 16-bit continuous controller command for transferring the operation value of a volume, a wheel or the like in the panel device of the host receiving column in the standard protocol is represented in such a manner that the transmission destination address is the address "0001 000" indicating the host, the transmission source address is the address "0011 aaa" of the panel device (where "aaa" is the sub-address of the panel device concerned), the data 1 as the index is "Exh," the data 2 is the eight high-order bits of the operation value of the controller, and the data 3 is the eight low-order bits of the operation value of the controller. Since "xh" is the port number, 16-bit continuous controller commands for 16 ports can be issued. It should be noted that the devices of the combination keyboard-panel type can transmit both commands for the keyboard device and the panel device. Further, the continuous controller command and the JOG controller command may be sent from the keyboard device.

Next, commands of the host transmitting column in the standard protocol will be described. A common protocol command of the host transmitting column is the same as the common protocol shown in FIG. 7, and therefore, the explanation will be omitted.

An LED control command of the host transmitting column is a command used by the host for controlling the intensity of a group to which LEDs (Light Emitting Diode) provided in the panel device belong. The LED control command is represented in such a manner that the transmission destination address is the address "0011 aaa" of the panel device whose intensity is controlled (where "aaa" is the sub-address of the panel device concerned), the transmission source address is the address "0001 000" indicating the host, the data 1 as the index is "6xh," the data 2 is a group number (8 bits) of LEDs whose intensity is controlled, the data 3 is an 8-bit LED intensity value as an intensity control value. Since "xh" is the port number, 16-port LED control commands can be issued. It should be noted here that since the intensity of a group "00h" is the minimum (equivalent to OFF), and a group "FFh" is the maximum (equivalent to ON), the intensity of these groups can not be changed.

An LED command of the host transmitting column is a command used by the host for dividing LEDs provided in the panel device among groups. The LED command is represented in such a manner that the transmission destination address is the address "0011 aaa" of the panel device controlled (where "aaa" is the sub-address of the panel device concerned), the transmission source address is the address "0001 000" indicating the host, the data 1 as the index is "7xh," the data 2 represents one of 8-bit LED numbers divided among groups, and the data 3 represents one of 8-bit group numbers among which the LEDs are divided. Since "xh" is the port number and the LED number is represented in 8 bits, 16 ports×256 LED control commands can be issued.

Description will be made here about how to use the LED control command and the LED command. When the host sends a panel device the LED command for dividing an LED "i" in a group "FFh," the panel device that has received the LED command turns on the LED whose LED number is "i." On the other hand, when the host sends the panel device the LED command for diving an LED "j" in a group "00h," the LED command for dividing an LED "i" in a group "FFh," the panel device that has received the LED command turns off the LED whose LED number is "j."

Further, the host sends the panel device the LED control command for setting the intensity of a group "01h" to that of a group "00h" (minimum value), and then, two or more of the LED commands for dividing required LED numbers of LEDs in the group "01h." Finally, the host sends the LED control command for setting the intensity of the group "01h" to that of a group "FFh" (maximum value) so that the LEDs of the panel device concerned can be turned on at the same time.

A keyboard LED control command of the host transmitting column is a command used by the host for controlling the intensity of a group to which an LED (performance guiding LED) provided for each key of a keyboard device belongs. The keyboard LED control command is represented in such a manner that the transmission destination address is the address "0010 aaa" of the keyboard device whose intensity is controlled (where "aaa" is the sub-address of the keyboard device concerned), the transmission source address is the address "0001 000" indicating the host, the data 1 as the index is "8xh," the data 2 is a group number (8 bits) whose intensity is controlled, the data 3 is an 8-bit LED intensity value as an intensity control value. Since "xh" is the port number, 16-port LED control commands can be issued. It should be noted here that since the intensity of the group "00h" is the minimum (equivalent to OFF), and the group "FFh" is the maximum (equivalent to ON), the intensity of these groups can not be changed.

A keyboard LED command of the host transmitting column is a command used by the host for dividing LEDs provided in the keyboard device among groups. The LED command is represented in such a manner that the transmission destination address is the address "0010 aaa" of the keyboard device controlled (where "aaa" is the sub-address of the keyboard device concerned), the transmission source address is the address "0001 000" indicating the host, the data 1 as the index is "9xh," the data 2 represents one of 8-bit note numbers of keys for which LEDs are so provided that they are divided among groups, and the data 3 represents one of 8-bit group numbers among which the LEDs are divided. Since "xh" is the port number and the note number is represented in 8 bits, 16 ports×256 keyboard LED control commands can be issued. A mode of control of keyboard LEDs by the keyboard LED control command and the keyboard LED command is the same as that of control of panel device LEDs by the LED control command and the LED command. Since the number of keys of each keyboard device are 256 at the maximum in accordance with the keyboard OFF command and the keyboard ON command, each of port numbers in the keyboard LED control command and the keyboard LED command, for example, can be used for control of color by preparing two or more colors for each key, or control of LED lit-position by providing LEDs at two or more places on each key.

A continuous controller command of the host transmitting command column in the standard protocol is used by the host for controlling the operation value of an electrically-driven volume or wheel in the panel device. The continuous controller command is represented in such a manner that the transmission destination address is the address "0011 aaa" of the panel device controlled (where "aaa" is the sub-address of the panel device concerned), the transmission source address is "0001 000" indicative of the host, the data 1 as the index is "Bxh," the data 2 represents the kind of controller such as the electrically-driven volume or wheel (8 bits), and the data 3 represents an 8-bit control value for the electrically-driven controller. Since "xh" is the port number and the kind is represented in 8 bits, 16 ports×256 continuous controller commands can be issued.

A JOG controller command of the host transmitting command column in the standard protocol is used by the host for controlling the operation value of an electrically-driven JOG controller such as a rotary encoder in the panel device. The JOG controller command is represented in such a manner that the transmission destination address is the address "0011 aaa" of the panel device controlled (where "aaa" is the sub-address of the panel device concerned), the transmission source address is "0001 000" indicative of the host, the data 1 as the index is "Cxh," the data 2 represents the kind of the electrically-driven JOG controller (8 bits), and the data 3 represents a relative value (in 8 bits) of two's-complement numbers for use in controlling the electrically-driven controller. Since "xh" is the port number and the kind is represented in 8 bits, 16 ports×256 continuous controller commands can be issued.

A 16-bit continuous controller command of the host transmitting command column in the standard protocol is used by the host for controlling the operation value of the electrically-driven volume or wheel in the panel device. The continuous controller command is represented in such a manner that the transmission destination address is the address "0011 aaa" of the panel device controlled (where "aaa" is the sub-address of the panel device concerned), the transmission source address is "0001 000" indicating the host, the data 1 as the index is "Exh," the data 2 represents the 8 high-order bits of a control value for the electrically-driven controller, and the data 3 represents the 8 low-order bits of the control value for the electrically-driven controller. Since "xh" is the port number, 16-bit continuous controller commands can be issued for 16 ports.

Next, MIDI protocol commands shown in FIG. 9 will be described. The MIDI protocol is a communication protocol capable of being used when the device (main controller) of the host type and the device of the Midi type communicate with each other. Commands in the MIDI protocol use both the standard data format and the extended data format. In the MIDI protocol, the commands are shared between host transmission and host reception except that the transmission destination address and the transmission source address are made different between them. In other words, the host receiving commands are such that the transmission destination address is "0001 001" as the MIDI protocol address of the host, and the transmission source address is the address of the MIDI device as the transmitter. On the other hand, the host transmitting commands are such that the transmission destination address is the address of the MIDI device, and the transmission source address is "0001 001" as the MIDI protocol address of the host. For each command of the MIDI protocol shown in FIG. 9, the transmission destination address and the transmission source address are set in the same manner as stated above. Therefore, the following description will be made about only the data format and the data part of each command.

A common protocol command in the MIDI protocol is the same as the common protocol shown in FIG. 7, and therefore, the explanation will be omitted.

A system exclusive (Sys EX) start and continue command and a system exclusive (Sys EX) end or one packet command are represented in the same data format that is the extended mode of length 17 bytes. The system exclusive (Sys EX) start and continue command is represented in such a manner that the data 1 is "4ih" as the index indicative of the start and resumption of the system exclusive, and the data 2 through the data 15 transfer data such as timber parameters and sequence data on a byte basis. The system exclusive (Sys EX) end command is represented in such a manner that the data 1 is "5ih" as the index indicative of the end of the system exclusive or one packet, and in the case of the one packet command, the data 2 through the data 15 transfer one packet of data on a byte basis.

In the MIDI, the start and end of the system exclusive are represented as "F0h" and "F7h" respectively, while in the E-bus system, the start and end of the system exclusive are represented as "4ih" and "5ih" instead without the use of "F0h" and "F7h." Further, "ih" represents the number of MIDI ports from which the system exclusive is transmitted.

A song position (Song Pos) command is a command that indicates the position from which performance is started, and is represented in the standard data format. The song position command is represented in such a manner that the data 1 is "6ih" as the index, the data 2 is the LSB of a pointer of the performance starting position, and the data 3 is the MSB of the pointer of the performance starting position. In the MIDI, a message of the song position pointer is represented as "F2h," and the data 2 and data 3 are made compatible with the message.

A MIDI port select command is to select a current MIDI port number (the number of a MIDI port at which a note-on message and a note-off message are exchanged), and is represented in the standard data format. The MIDI port select command is represented in such a manner that the data 1 is "7ih" as the index, the data 2 is "00h" and the data 3 is "00h." For example, if the MIDI port select command is transmitted from the host to the MIDI device, the MIDI device that has received the command sets the current MIDI port number to "ih" contained in the index. In the MIDI standard, the port select message is not defined (in an on-board situation, "F5h" may be used). The MIDI port select command corresponds to the time-piece message function in the MIDI.

Two MIDI-compatible (note, vel) commands are compatible with the note-on message and note-off message in the MIDI, and is represented in the standard data format. In these commands are represented, if the data 1 is "8nh" as the index of note-off in the MIDI, the data 2 represents a MIDI-compatible, 8-bit number of the note that was noted off, and the data 3 represents a MIDI-compatible, 8-bit off-velocity, it becomes the note-off command. Alternatively, such a command that the data 1 is "9nh" as the index of note-on in the MIDI, the data 2 represents a MIDI-compatible, 8-bit number of the note that was noted off, and the data 3 is "00h" (zero velocity) may be used as the note-off command. Here, "nh" is a MIDI channel number.

A MIDI-compatible (note, Aft) command is compatible with a polyphonic key-pressure message in the MIDI, and is a command capable of sending after-touch information independently provided for each key. The command is represented in the standard data format. In the command, the data 1 is "Anh" as the index of polyphonic key pressure in the MIDI, the data 2 represents a note number for use in sending MIDI-compatible, 8-bit after-touch information, and the data 3 represents a MIDI-compatible, 8-bit touch value. Here, "nh" is a MIDI channel number.

A MIDI compatible (CtnNo., Value) command is compatible with a control change message in the MIDI, and is represented as a command capable of sending controller information such as a damper, pedal, volume, modulation or wheel. In the command, the data 1 is "Bnh" as the index of control change in the MIDI, the data 2 is a MIDI-compatible, 8-bit control number indicative of control functions, and the data 3 is a MIDI-compatible, 8-bit control value. Here, "nh" is a MIDI channel number.

A MIDI compatible (PrgNo., 00) command is compatible with a program change message in the MIDI, and is a command for changing timbres. The command is represented in the standard data format. In the command, the data 1 is "Cnh" as the index of program change in the MIDI, the data 2 is a MIDI-compatible, 8-bit program number and the data 3 is "00h" because of no need for the program change message in the MIDI. Here, "nh" is a MIDI channel number.

A MIDI compatible (Aft, 00) command is compatible with channel pressure in the MIDI, and is a command for changing timbres. The command is represented in the standard data format. In the command, the data 1 is "Dnh" as the index of channel pressure in the MIDI, the data 2 is a MIDI-compatible, 8-bit after-touch value and the data 3 is "00h" because of no need for the program change message in the MIDI. Here, "nh" is a MIDI channel number. Since this command is to send representative after-touch information, if plural note-on events exist, the after-touch information includes all the note-on events.

A MIDI compatible (BendL, H) command is compatible with a pitch bend message in the MIDI, and is a command for sending information about a pitch bender composed of a wheel and a joystick. The command is represented in the standard data format. In the command, the data 1 is "Enh" as the index of pitch bend in the MIDI, the data 2 is the LSB of a MIDI-compatible, 8-bit pitch bend value and the data 3 is the MSB of the MIDI-compatible, 8-bit pitch bend value. Here, "nh" is a MIDI channel number.

In the MIDI, statuses "F0h" to "F7h" are defined except that "F4h" and "F5h" are undefined. Further, as stated above, statuses of the start and end of the system exclusive in the MIDI, "F0h" and "F7h" are not used, and they are converted to "4ih" and "5ih" in the E-bus system. Similarly, a status "F2h" in the MIDI is converted to an index "6xh" in the E-bus system, or to an index "7xh" in the E-bus system when the status "F5h" in the MIDI is defined as MIDI Time Piece. The reason why some of the statuses "F0h" to "F7h" are converted is that the number of bytes is incremented by one in some of the statues, or specification of a MIDI port number can be made possible by the increased byte. In the MIDI standard, it is judged, from the most significant bit of each byte of a message, whether the byte is a status byte or data byte. In contrast, in the above-mentioned MIDI protocol, the data 1 of the standard data is always a command, which eliminate the need to use the most significant bit for the same purpose. Therefore, in the above-mentioned MIDI protocol, "00h" to "7Fh," which deviate from the MIDI status bytes, are used as a common protocol command or MIDI extending command.

Further, a FI (MIDI Timecode Quarter Frame) command is to send hr/min/sec. information in the MIDI timecode. The command is represented in the standard data format. In the command, the data 1 is "Fih" as the index, the data 2 is "F1h" indicative of a status of MIDI Timecode Quarter Frame, and the data 3 represents a MIDI-compatible, 8-bit hr/min/sec. value.

Furthermore, a F3 (Song Select) command is to select a piece of music stored in a memory or storage medium. The command is represented in the standard data format. In the command, the data 1 is "Fih" as the index, the data 2 is "F3h" indicative of a status of Song Select in the MIDI, and the data 3 represents a MIDI-compatible, 8-bit song number.

Furthermore, a F6 (Tune Request) command is to tune a MIDI device with auto-tuning capability. The command is represented in the standard data format. In the command, the data 1 is "Fih" as the index, the data 2 is "F6h" indicative of a status of Tune Request in the MIDI, and the data 3 is "00h" because of no need in the MIDI.

Furthermore, a system real-time message command is to send a message necessary to be processed in real time. The command is represented in the standard data format. In the command, the data 1 is "Fih" as the index, the data 2 is any one of "F8h" through "FFh" indicative of a status of the system real-time message in the MIDI, and the data 3 is "00h" because of no need in the MIDI. The data 2 is:

status "F8h" for timing clock function;

status "FAh" for start function;

status "FBh" for continue function;

status "FCh" for stop function; and status "FFh" for system reset function.

Here, statuses "F9h" and "FDh" are undefined, and status "FEh," though defined as active sensing, is not used in the E-bus system according to the present invention. In the above-mentioned commands whose data 1 is "Fih," "ih" represents a MIDI port number from which the command concerned is sent out.

Figure 10:
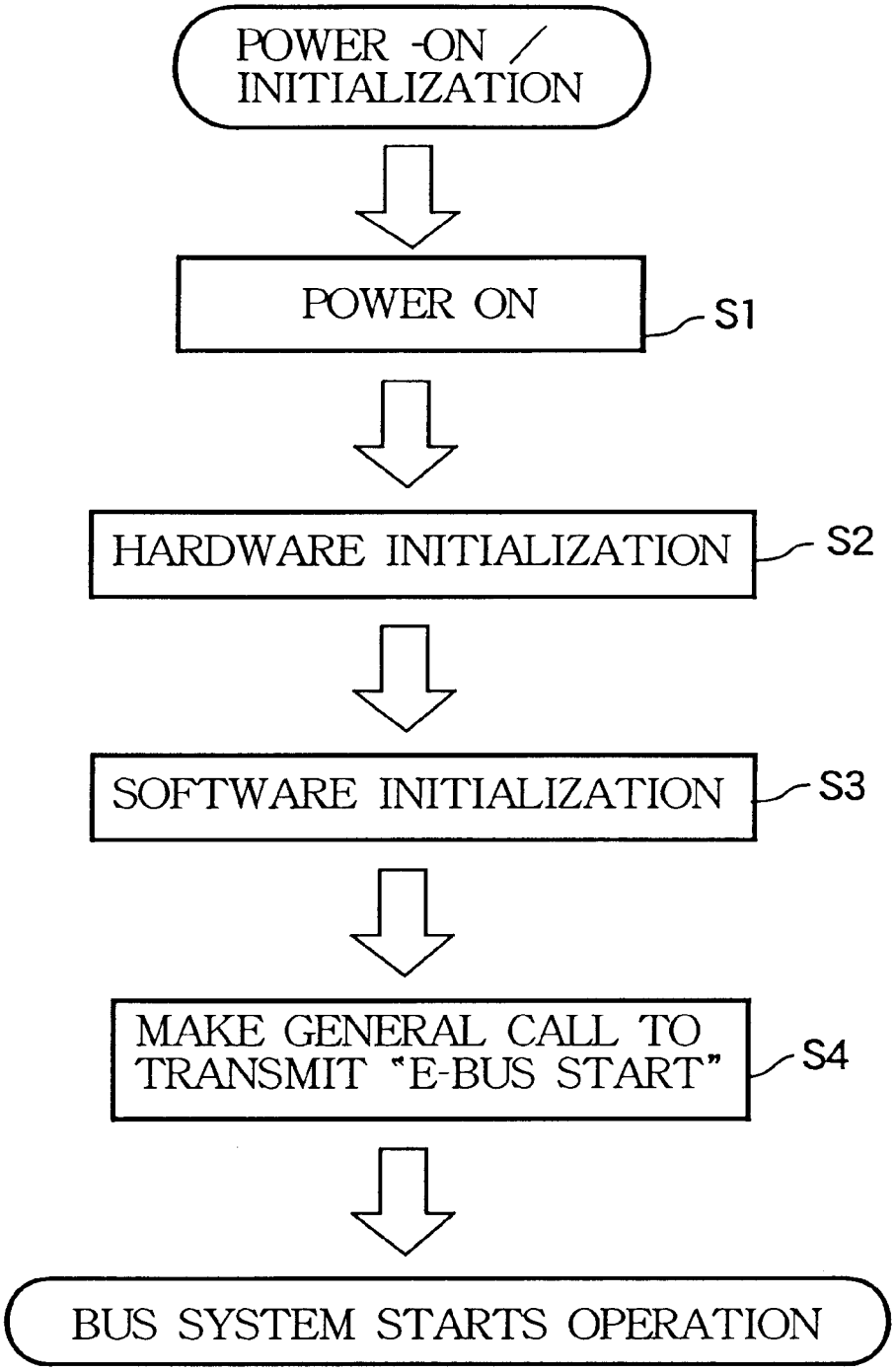
FIG. 10 is a flowchart showing an E-bus start-up procedure in the E-bus system according to the embodiment of the present invention.

FIG. 10 is a flowchart showing an E-bus start-up procedure in the E-bus system according to the present invention.

When the E-bus system is switched on (step S1), power is supplied through four power lines of the E-bus 11 to all the devices connected to the E-bus system. Of all the devices, the host (main controller device 10) turns the initial clear line of the E-bus 11 to the L level. As a result, the functions of the devices connected to the E-bus system is stopped and reset, and device hardware is initialized (step S2). Then the host (main controller device 10) turns the initial clear line of the E-bus 11 to the H level to activate the devices connected to the E-bus system. As a result, software in the devices connected to the E-bus system is initialized (step S3). After that, the host (main controller device 10) makes a general call to transmit the "E-bus start" command shown in FIG. 7 (step S4). Upon receipt of the "E-bus start" command, each device connected to the E-bus system starts operating to start the operation of the E-bus system. It should be noted that the creation of the above-mentioned table using the category ID/sub-address request command in the host type is carried out immediately after the "E-bus start" command is sent out.

Figure 11:
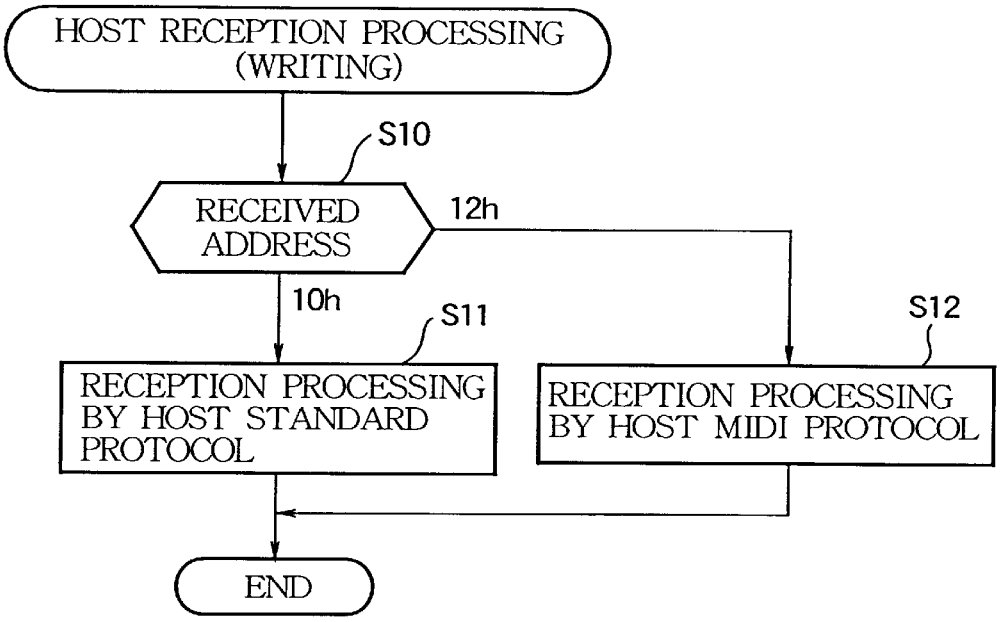
FIG. 11 is a flowchart showing host reception processing in the E-bus system according to the embodiment of the present invention.

FIG. 11 is a flowchart showing host reception processing in the E-bus system according to the present invention.

In the host reception processing shown in FIG. 11, when receiving a signal from the E-bus 11, the host (main controller device 10) judges in step S10 whether the transmission destination address received is "10h" or "12h." Since this is host reception processing, the transmission destination address in this case becomes the address of the host specified. Here, the address of the host judged in step S10 contains an R/W bit, which is always "0." If it is judged that the transmission destination address received is "10h" (equal to "0001 0000"), since it means that the address of the host for the standard protocol is specified, the procedure advances to step S11. In step S11, standard protocol reception processing for receiving the transmission source address and the data part consisting of the data 1 to 3 is performed. Further, if an effective signal can be obtained, an acknowledge is retuned every byte. In the standard protocol reception processing, the host receives commands such as keyboard OFF or keyboard ON from the keyboard device, or commands such as SW ON or continuous controller from the panel device.

If it is judged that the transmission destination address received is "12h" (equal to "0001 0010"), since it means that the address of the host for the MIDI protocol is specified, the procedure branches to step S12. In step S12, MIDI protocol reception processing for receiving the transmission source address and the data part consisting of the data 1 to 3 or the data 1 through 15 is performed. Further, if an effective signal can be obtained, an acknowledge is retuned every byte. After completion of the processing step S11 or S12, the host reception processing is also ended. In the MIDI protocol reception processing, the host receives MIDI message commands such as note-on and note-off from the MIDI input/output device.

Figure 12:
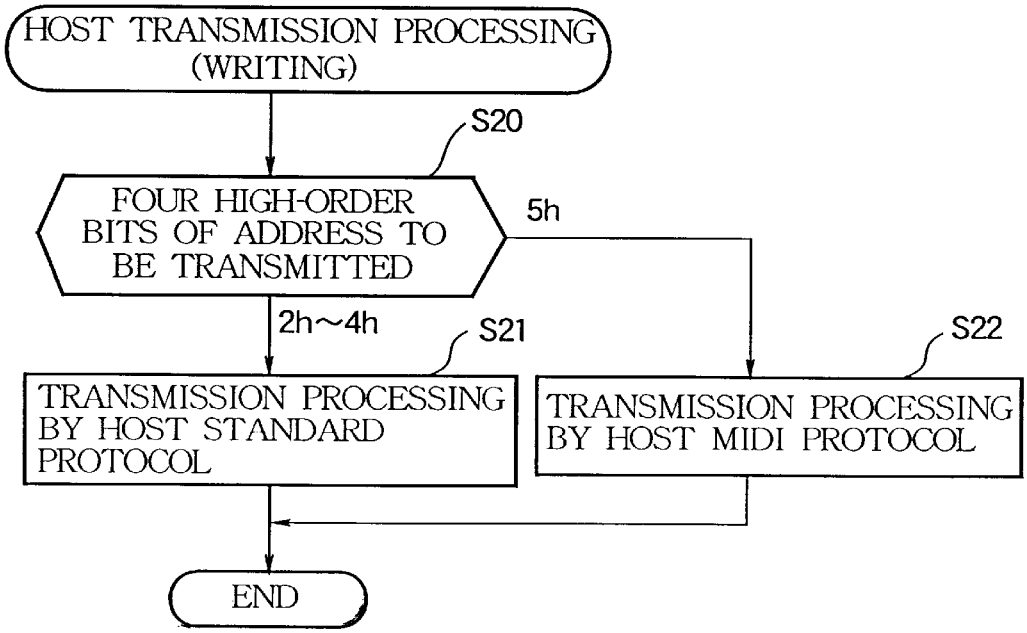
FIG. 12 is a flowchart showing host transmission processing in the E-bus system according to the embodiment of the present invention.

FIG. 12 is a flowchart showing host transmission processing in the E-bus system according to the present invention.

In the host transmission processing shown in FIG. 12, when performing transmission to the E-bus 11, the host (main controller device 10) judges in step S20 whether the four high-order bits of the transmission destination address transmitted for addressing are "2h" to "4h" or "5h." Since this is host transmission processing, the four high-order bits of the transmission destination address in this case becomes the category ID of the transmission destination device addressed by the host. If it is judged that the four high-order bits of the transmission destination address to be transmitted are "2h" to "4h" (equal to "0001" to "0100"), any one of the devices of the keyboard type, panel type or combination keyboard-panel type is the transmission destination device. Since the devices of these categories use the standard protocol as their communication protocol as shown in FIG. 5, the procedure advances to step S21. In step S21, standard protocol transmission processing for adding the standard protocol address "0001 000" of the host as the transmission source address, and then, transmitting the data part consisting of the data 1 to 3 is performed. In the standard protocol transmission processing, the host transmits, for example, to the panel device, commands such as the LED command for turning on the LED with the LED number i (the command for dividing the LED "i" in the group "FFh").

If it is judged that the four high-order bits of the transmission destination address to be transmitted are "5h" (equal to "0101"), any one of the devices of the Midi type becomes the transmission destination device. Since the devices of the Midi type category use the MIDI protocol as their communication protocol as shown in FIG. 5, the procedure branches to step S22. In step S22, MIDI protocol transmission processing for adding the MIDI protocol address "0001 001" of the host as the transmission source address, and then, transmitting the data part consisting of the data 1 to 3 or the data 1 through 15 is performed. After completion of the transmission processing step S21 or S22, the host transmission processing is also ended. In the MIDI protocol transmission processing, the host transmits, for example, to a MIDI sequencer, MIDI message commands such as note-on and note-off.

Figure 13:
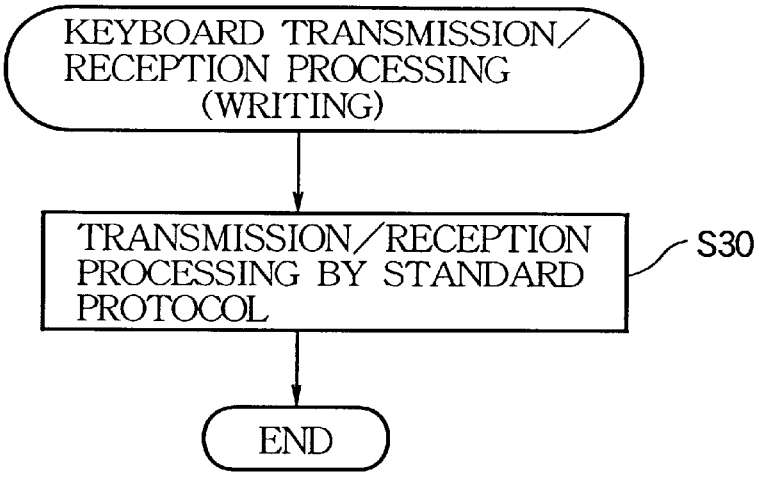
FIG. 13 is a flowchart showing keyboard transmission/reception processing in the E-bus system according to the embodiment of the present invention.

FIG. 13 is a flowchart showing keyboard device transmission/reception processing in the E-bus system according to the present invention.

In the keyboard device transmission/reception processing shown in FIG. 13, since the communication protocol is the standard protocol, standard protocol transmission/reception processing is performed in step S30. In the standard protocol transmission processing, the standard protocol address "0001 000" of the host is specified and transmitted as the transmission destination address to be addressed, while the address of its own machine is specified and transmitted as the transmission source address. The address of its own machine is represented in such a manner that the category ID is "0010" and the sub-address is a 3-bit address set for its own machine. Following these addresses, the data part consisting of the data 1 to 3 is transmitted.

In the standard protocol reception processing, when the transmission destination address specified for addressing and the address of its own machine coincide with each other, the following transmission source address and the data part consisting of the data 1 to 3 are received. In this case, the standard protocol address "0001 000" of the host is specified as the transmission source address.

In the standard protocol, although the devices of the panel type and combination keyboard-panel type also conduct communication, the transmission/reception processing in this case is the same as the above-mentioned keyboard transmission/reception processing except that the category ID is different between them.

Figure 14:
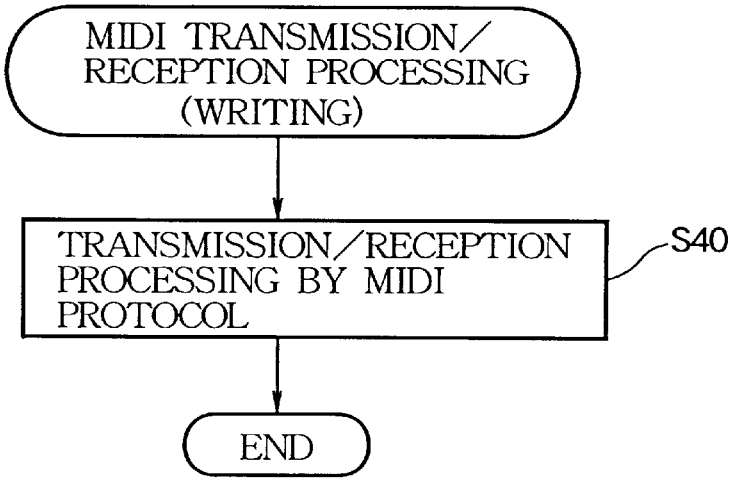
FIG. 14 is a flowchart showing MIDI transmission/reception processing in the E-bus system according to the embodiment of the present invention.

FIG. 14 is a flowchart showing MIDI device transmission/reception processing in the E-bus system according to the present invention.

In the MIDI device transmission/reception processing shown in FIG. 14, since the communication protocol is the MIDI protocol, MIDI protocol transmission/reception processing is performed in step S40. In the MIDI protocol transmission processing, the MIDI protocol address "0001 001" of the host is specified and transmitted as the transmission destination address to be addressed, while the address of its own machine is specified and transmitted as the transmission source address. The address of its own machine is represented in such a manner that the category ID is "0101" and the sub-address is a 3-bit address set for its own machine. Following these addresses, the data part consisting of the data 1 to 3 or the data 1 through 15 is transmitted.

In the MIDI protocol reception processing, when the transmission destination address specified for addressing and the address of its own machine coincide with each other, the following transmission source address and the data part consisting of the data 1 to 3 or the data 1 through 15 are received. In this case, the MIDI protocol address "0001 001" of the host is specified as the transmission source address.

The host is operative to create a MIDI note-on message in response to the keyboard ON command from the keyboard, controls the creation of a tone in the tone generator unit according to the note-on message, and sends the note-on message to the MIDI device through the E-bus. When receiving the SW ON command from the panel, the host performs various processing according to the kind of the SW ON command, such as the selection of sounding timbre data, editing of the timbre data, recording/reproduction of music data for automatic performance, editing of the music data, change in setting of own device and change in setting of each device connected to the E-bus. Further, upon selecting timbre data, the host, for example, transmits the LED command to the panel device so that an LED corresponding to the selected timbre data will be turned on, as well as sending the MIDI device a program change message corresponding the selection. Furthermore, when reproducing music data (at the time of automatic performance), the host controls the creation of tones in the tone generator units according to the MIDI message to be reproduced sequentially, as well as sending the MIDI device the MIDI message through the E-bus.

In the above description, each LED provided in the keyboard or panel device was made to belong to any one of groups, but an LED may be made to belong to two or more groups. In such a case, the control value for the LED may be the maximum value, minimum value or combined value of the groups to which the LED belongs. Further, in the above description, the "host type," the "keyboard type," the "panel type," and "Midi type" were exemplified as devices connected to the E-bus, but any other kind of device may be connected. Furthermore, the three protocols, namely the "common protocol," the "standard protocol," and the "MIDI protocol" were exemplified as the data protocols on the E-bus, but any other protocol may be adopted as well.

The E-bus system described above and according to the present invention is based on an $I^2C$ bus, and such points as not to make references to the E-bus system are based on the $I^2C$ bus standard.

The present invention configured as discussed above enables communications through a bus system among devices constituting an electronic musical instrument. In this case, an address inherent in a device as a transmission destination is added to a data signal from a master. The address is composed of category information representative of the category of the device and an sub-address for specifying any one of devices in the same category. Thus communications can be carried out among devices of various categories through the bus system. For example, when a new keyboard has been developed for the electronic musical instrument, the new keyboard has only to be connected to the electronic musical instrument bus system to construct an electronic musical instrument provided with a newly developed keyboard. In this case, the devices of the other categories, for example, the devices of the panel type and the host type can be used as they are.

Further, when a device is added with the addition of a function, the device to be added has only to be connected to the electronic musical instrument to construct an electronic musical instrument with a new device added thereto. Therefore, product development costs can be remarkably reduced, and any function can be added in a short time.

Thus the present invention allows each device to be used in other products, which in turn makes it possible to develop the products on a device basis.

According to other aspects of the present invention, the operation/input devices such as the keyboards and panels and the MIDI devices can be randomly connected to construct the electronic musical instrument. Further, major packet lengths exchanged between the operation/input devices such as the keyboards or panels and the MIDI devices are integrated into the fist predetermined length, which makes it possible to simplify reception processing by each device. Furthermore, since only the system exclusive that tends to be longer in byte length is transmitted in the second predetermined length longer than the first predetermined length, communication efficiency of the system exclusive cannot drop. Furthermore, the plural visual elements can be controlled at the same time, and if few changes in combination of visual elements to be controlled occur, the number of command issues for controlling the displays can be reduced. In addition, any MIDI message can be transmitted and received in the electronic musical instrument bus system without affecting the MIDI message.

What is claimed is:

1. A bus system interconnecting a plurality of devices of various categories constituting an electronic music instrument apparatus for exchanging signals among the devices having unique addresses, the bus system comprising a serial clock line connecting to the devices for transmission of a clock signal, and a serial data line connecting to the devices for transfer of a data signal from a source device to a destination device in synchronization with the clock signal, wherein the source device operates as a master to commence a communicating session such as to send the clock signal to the serial clock line and to send the data signal to the serial data line in synchronization with the clock signal, and the destination device operates as a slave during the communicating session such as to receive the data signal through the serial data line based on the clock signal fed from the serial clock line, wherein the source device formulates the data signal containing a unique address specifying the destination device such that the destination device can receive the data signal exclusively from the source device, the unique address comprising category information designating a category to which the destination device belongs and a sub-address specifying the destination device in the designated category, wherein the devices have outputs of the clock signals connected to the serial clock line through wired AND connectors and outputs of the data signals connected to the serial data line through wired AND connections, and wherein the devices have respective orders of priority determined according to the respective categories of the devices, and in case that two or more of source devices try to commence respective communicating sessions to respective destination devices, the source device having the communicating session to the destination device of the category having the highest order of the priority precedes as the master of the communicating session according to the unique addresses of the respective destination devices contained in the data signals directed thereto.

2. The bus system according to claim 1, wherein the source device produces the data signal composed of data and index information which precedes the data and indicates a kind of the data.

3. The bus system according to claim 1, adapting to a plurality of specific protocols dedicated to a plurality of categories of the devices and a general protocol common to all of the categories, wherein the source device can selectively use either of the specific protocol dedicated to the destination device or the general protocol for handling the communicating session between the source device and the destination device.

4. The bus system according to claim 1, wherein a source device belonging to a category of a host type can use a plurality of protocols dedicated to respective categories of the devices, and wherein the source device belonging to the category of the host type selects the protocol dedicated to the category of the destination device for handling the communicating session between the source device and the destination device.

5. The bus system according to claim 4, wherein the source device belonging to the category of the host type formulates the data signal containing an address which corresponds to the selected protocol and which specifies the destination device such that the source device can handle the communicating session with the destination device by the selected protocol.

6. The bus system according to claim 1, wherein the devices are classified into four categories of a host type having a first order of the priority, a keyboard type having a second order of the priority, a panel type having a third order of the priority and a MIDI type having a fourth order of the priority.

7. The bus system according to claim 3, wherein the devices are classified into a category of a host type and other categories than the host type, such that a device belonging to the other categories uses one specific protocol dedicated to the device for handling the communicating session, and does not use another specific protocol not dedicated to the device.

8. The bus system according to claim 3, wherein the devices are classified into a category of a host type and other categories than the host type, such that a device belonging to the category of the host type can use respective specific protocols dedicated to respective devices of the other categories for handling the communicating session with the respective devices of the other categories.

9. The bus system according to claim 3, wherein the source device produces the data signal composed of data and index information which precedes the data and indicates a kind of the data, such that the destination device can recognize whether the general protocol or the specific protocol is used for the communicating session according to the index information.

10. A bus system interconnecting a plurality of devices of various categories constituting an electronic music instrument apparatus for exchanging signals among the devices having unique addresses, the bus system comprising a serial clock line connecting to the devices for transmission of a clock signal, and a serial data line connecting to the devices for transfer of a data signal from a source device to a destination device in synchronization with the clock signal, wherein the source device operates as a master to commence a communicating session such as to send the clock signal to the serial clock line and to send the data signal to the serial data line in synchronization with the clock signal, and the destination device operates as a slave during the communicating session such as to receive the data signal through the serial data line based on the clock signal fed from the serial clock line, wherein the source device formulates the data signal containing a unique address specifying the destination device such that the destination device can receive the data signal exclusively from the source device, the unique address comprising category information designating a category to which the destination device belongs and a sub-address specifying the destination device in the designated category, and, wherein the devices are classified into four categories of a host type having a first priority, a keyboard type having a second priority, a panel type having a third priority and a MIDI type having a fourth priority, and in case that two or more of source devices try to commence respective communicating sessions to respective destination devices of different categories, the source device having the communicating session to the destination device of the category having the highest priority precedes as the master of the communicating session.

11. A bus system comprising a bus supporting a session of transfer of music data by a bi-directional serial communication, and a plurality of devices interconnected to each other through the bus to constitute an electronic musical instrument apparatus such that one of the devices may become a master by its own initiative to conduct a session, and another of the devices may become a slave when addressed by the master during the session, wherein the devices include a manual input device being composed of either a keyboard or an operating panel for inputting the music data and being adaptable to the bus for conducting a session of transfer of the music data, a MIDI device being designed for treating the music data in MIDI format and being adaptable to the bus for conducting a session of transfer of the music data, and a host device being capable of controlling the manual input device and the MIDI device and being adaptable to the bus for conducting a session of transfer of the music data, and wherein the manual input device can be detached from the bus and another manual input device can be attached to the bus so as to change a constitution of the electronic musical instrument apparatus while maintaining the connection of the host device to the bus.

12. The bus system according to claim 11, wherein the session held between the host device and the manual input device is designed to transfer the music data in a packet form having a first data length, and the session held between the host device and the MIDI device treats the music data including a MIDI message and a system exclusive message such that the session transfers the MIDI message in a packet form having the first data length and transfers the system exclusive message in another packet form having a second data length longer than the first data length.

13. The bus system according to claim 11, wherein the manual input device includes a plurality of visual elements for visually indicating music information, and the host device can initiate a session to transfer music data including a group message and a mode message to the manual input device, the group message being effective to divide the plurality of the visual elements into groups, and the mode message being effective to totally control a mode of indicating the music information by the visual elements in the same group.

14. The bus system according to claim 13, wherein the groups may include a group containing visual elements having a fixed mode of indicating the music information.

15. The bus system according to claim 11, wherein a session held between the host device and the MIDI device is designed to transfer the music data representing a MIDI message comprised of a status byte and data bytes subsequent to the status byte, and wherein the MIDI message is transmitted in the form of a packet comprised of a header and a data part, the data part containing the data bytes and index information indicating a type of the MIDI message that corresponds to the status byte, the header containing an address specifying a destination device of the MIDI message.

16. The bus system according to claim 15, wherein the destination device reconstructs the received packet into the MIDI message by changing the index information contained in the package into the corresponding status byte.

17. An electronic musical instrument apparatus for generation of music sounds, comprising:

a bus supporting a session of transfer of data by a bi-directional serial communication; and a plurality of devices belonging to different categories having different priorities and being connected to the bus for exchanging control data effective to control the generation of the music sounds, wherein one of the devices may become a source device to initiate a session to transfer the control data while another of the devices may become a destination device to receive the control data when addressed by the source device, and in case a conflict occurs such that two or more of the source devices try to commence respective sessions to respective destination devices of different categories, the source device having the session to the destination device of the category having the highest priority precedes to establish the session.

18. The electronic musical instrument apparatus according to claim 17, wherein the plurality of the devices may be selected from a group consisting of a keyboard device designed for inputting the control data, a panel device designed for inputting the control data, a MIDI device designed for treating the control data in MIDI format, and a host device capable of controlling the keyboard device, the panel device and the MIDI device.

19. An electronic musical instrument apparatus for generation of music sounds, comprising:

a bus supporting a session of transfer of data by a bi-directional serial communication, and being equipped with at least a first connector having a standardized configuration and a second connector having the same standardized configuration;

a manual input device including a keyboard device and a panel device, the keyboard device being manually operable to input control data, and having a first bus terminal of a standardized configuration adapted to engage with the first connector of the bus for conducting a session of transfer of the control data, the panel device being manually operable to input control data, and having a second bus terminal of the same standardized configuration adapted to engage with the second connector of the bus for conducting a session of transfer of the control data; and a host device connected to the bus for receiving the control data from the keyboard device and the panel device so as to manage the generation of the music sounds, wherein the keyboard device may alternatively engage with the second connector by the first bus terminal and the panel device may alternatively engage with the first connector by the second bus terminal, and wherein the manual input device can be detached from the bus and another manual input device can be attached to the bus so as to change a constitution of the electronic musical instrument apparatus while maintaining the connection of the host device to the bus.

20. An electronic musical instrument apparatus for generation of music sounds, comprising:

a bus supporting a session of transfer of data by a bi-directional serial communication for managing the generation of the music sounds, and being equipped with at least a first connector having a standardized configuration and a second connector having the same standardized configuration;

a plurality of devices including a manual input device composed of either a keyboard or an operating panel for inputting the data, a MIDI device designed for treating the data in MIDI format, and a host device being capable of controlling the manual input device and the MIDI device;

a first device among the plurality of the devices, having a first bus terminal of a standardized configuration adapted to engage with the first connector of the bus for conducting a session of transfer of first data;

a second device among the plurality of the devices, having a second bus terminal of the same standardized configuration adapted to engage with the second connector of the bus for conducting a session of transfer of second data, wherein the first device may alternatively engage with the second connector by the first bus terminal for transfer of the first data, and the second device may alternatively engage with the first connector by the second bus terminal for transfer of the second data, and wherein the manual input device can be detached from the bus and another manual input device can be attached to the bus so as to change a constitution of the electronic musical instrument apparatus while maintaining the connection of the host device to the bus.

21. An electronic musical instrument apparatus for generation of music sounds, comprising:

a bus supporting a session of transfer of a control packet by a bi-directional serial communication; and a plurality of devices including a manual input device comprised of either a keyboard or an operating panel for inputting the control packet, a MIDI device designed for treating the control packet in MIDI format, and a host device being capable of controlling the manual input device and the MIDI device, the devices being connected to the bus for exchanging the control packet effective to control the generation of the music sounds, wherein one of the devices may become a source device to initiate a session to transfer the control packet while another of the devices may become a destination device to receive the control packet when addressed by the source device, the control packet containing address information effective to specify the destination device, and wherein the manual input device can be detached from the bus and another manual input device can be attached to the bus so as to change a constitution of the electronic musical instrument apparatus while maintaining the connection of the host device to the bus.

22. An electronic musical instrument apparatus for generation of music sounds, comprising:

a bus supporting a session of transfer of control data by a bi-directional serial communication; and a plurality of devices including a manual input device comprised of either a keyboard or an operating panel for inputting the control data, a MIDI device designed for treating the control data in MIDI format, and a host device being capable of controlling the manual input device and the MIDI device, the devices being connected to the bus for exchanging the control data effective to control the generation of the music sounds, wherein one of the devices may become a source device to initiate a session to transfer the control data while another of the devices may become a destination device to receive the control data when addressed by the source device, the control data containing address information effective to specify the destination device, and wherein the manual input device can be detached from the bus and another manual input device can be attached to the bus so as to change a constitution of the electronic musical instrument apparatus while maintaining the connection of the host device to the bus.

23. An electronic musical instrument apparatus for generation of music sounds, comprising:

a bus supporting a session of transfer of control data by a bi-directional serial communication;

one or more of manual input device for inputting the control data and being adaptable to the bus for conducting a session of transfer of the control data, the manual input device including a plurality of visual elements for visually indicating music information associated to the generation of the music sounds; and a host device being adaptable to the bus for receiving the control data from the manual input device so as to manage the generation of the music sounds, the host device further conducting a session to transfer control data including a group message and a mode message to the manual input device, the group message being effective to divide the plurality of the visual elements into groups, and the mode message being effective to totally control a mode of indicating the music information by the visual elements in the same group.

24. A method of operating a bus system interconnecting a plurality of devices of various categories constituting an electronic music instrument apparatus for exchanging signals among the devices having unique addresses, the bus system having a serial clock line connecting to the devices for transmission of a clock signal, and a serial data line connecting to the devices for transfer of a data signal from a source device to a destination device in synchronization with the clock signal, the devices have outputs of the clock signals connected to the serial clock line through wired AND connectors and outputs of the data signals connected to the serial data line through wired AND connections, the method comprising the steps of:

operating the source device as a master to commence a communicating session such as to send the clock signal to the serial clock line and to send the data signal to the serial data line in synchronization with the clock signal, and operating the destination device as a slave during the communicating session such as to receive the data signal through the serial data line based on the clock signal fed from the serial clock line, wherein the source device formulates the data signal containing a unique address specifying the destination device such that the destination device can receive the data signal exclusively from the source device, the unique address comprising category information designating a category to which the destination device belongs and a sub-address specifying the destination device in the designated category, and wherein the devices are allotted with respective orders of priority determined according to the respective categories of the devices, and in case that two or more of source devices try to commence respective communicating sessions to respective destination devices, the source device having the communicating session to the destination device of the category allotted the highest order of the priority precedes as the master of the communicating session according to the unique addresses of the respective destination devices contained in the data signal directed thereto.

25. A computer program installable in a bus system interconnecting a plurality of devices of various categories constituting an electronic music instrument apparatus for exchanging signals among the devices having unique addresses, the bus system having a serial clock line connecting to the devices for transmission of a clock signal, and a serial data line connecting to the devices for transfer of a data signal from a source device to a destination device in synchronization with the clock signal, the devices have outputs of the clock signals connected to the serial clock line through wired AND connectors and outputs of the data signals connected to the serial data line through wired AND connections, the computer program being executable in the bus system to perform a method comprising the steps of:

operating the source device as a master to commence a communicating session such as to send the clock signal to the serial clock line and to send the data signal to the serial data line in synchronization with the clock signal, and operating the destination device as a slave during the communicating session such as to receive the data signal through the serial data line based on the clock signal fed from the serial clock line, wherein the source device formulates the data signal containing a unique address specifying the destination device such that the destination device can receive the data signal exclusively from the source device, the unique address comprising category information designating a category to which the destination device belongs and a sub-address specifying the destination device in the designated category, and wherein the devices are allotted with respective orders of priority determined according to the respective categories of the devices, and in case that two or more of source devices try to commence respective communicating sessions to respective destination devices, the source device having the communicating session to the destination device of the category allotted the highest order of the priority precedes as the master of the communicating session according to the unique addresses of the respective destination devices contained in the data signals directed thereto.

* * * * *